US010867547B2

(12) United States Patent
An et al.

(10) Patent No.: US 10,867,547 B2
(45) Date of Patent: Dec. 15, 2020

(54) METHOD FOR DRIVING PLURALITY OF PIXEL LINES AND ELECTRONIC DEVICE THEREOF

(71) Applicant: SAMSUNG ELECTRONICS CO., LTD., Suwon-si (KR)

(72) Inventors: Jungchul An, Suwon-si (KR); Jongkon Bae, Suwon-si (KR); Donghwy Kim, Suwon-si (KR); Hyungsup Byeon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/374,928

(22) Filed: Apr. 4, 2019

(65) Prior Publication Data

US 2019/0311670 A1 Oct. 10, 2019

(30) Foreign Application Priority Data

Apr. 4, 2018 (KR) ..... 10-2018-0039381

(51) Int. Cl.
*G09G 3/20* (2006.01)
*G09G 5/38* (2006.01)

(52) U.S. Cl.
CPC ..... *G09G 3/2092* (2013.01); *G09G 5/38* (2013.01); *G09G 2310/0205* (2013.01);
(Continued)

(58) Field of Classification Search
CPC ... G09G 2340/0478; G09G 2310/0224; G09G 5/38; G09G 2354/00; G09G 2320/0261;
(Continued)

(56) References Cited

U.S. PATENT DOCUMENTS 9,865,203 B2 1/2018 Kim
2011/0164076 A1* 7/2011 Lee ..... G09G 3/3406 345/691

(Continued)

FOREIGN PATENT DOCUMENTS

JP 2009-103914 5/2009
KR 10-2010-0083016 7/2010

(Continued)

OTHER PUBLICATIONS

International Search Report and Written Opinion dated Jul. 29, 2019 in counterpart International Patent Application No. PCT/KR2019/003969.

*Primary Examiner* — Charles V Hicks
(74) *Attorney, Agent, or Firm* — Nixon & Vanderhye P.C.

(57) ABSTRACT

An electronic device includes a display panel including a first edge extending in a first direction and a second edge in a second direction perpendicular to the first direction, a first group of gate lines supplying a first gate voltage to a first pixel line and supplying a third gate voltage to a third pixel line, a second group of gate lines supplying a second gate voltage to a second pixel line and supplying a fourth gate voltage to a fourth pixel line, and at least one processor configured to control the electronic device to: sequentially supply the first gate voltage and the third gate voltage through the first group of gate lines to output a first part of specified image data and sequentially supply the second gate voltage and the fourth gate voltage through the second group of gate lines to output a second part of the specified image data the second part of the specified image data being different from the first part of the specified image data.

20 Claims, 16 Drawing Sheets

(52) U.S. Cl.
CPC . *G09G 2310/0213* (2013.01); *G09G 2310/08* (2013.01); *G09G 2320/0261* (2013.01); *G09G 2340/0471* (2013.01); *G09G 2340/0478* (2013.01); *G09G 2354/00* (2013.01)

(58) Field of Classification Search
CPC .... G09G 5/34; G09G 2310/08; G09G 3/2092; G09G 2310/0213; G09G 2310/0281; G09G 3/20; G09G 2340/0471; G09G 2310/0205
See application file for complete search history.

(56) References Cited

U.S. PATENT DOCUMENTS

| | | | | |
|---|---|---|---|---|
| 2016/0232860 | A1 | 8/2016 | Kim | |
| 2017/0316732 | A1 | 11/2017 | Na | |
| 2018/0061307 | A1* | 3/2018 | Inoue | H03F 3/45183 |

FOREIGN PATENT DOCUMENTS

| | | | |
|---|---|---|---|
| KR | 10-1248900 | | 4/2013 |
| KR | 10-1251377 | B1 | 4/2013 |
| KR | 10-2013-0065328 | | 6/2013 |
| KR | 10-2017-0122893 | | 11/2017 |
| KR | 10-2017-0124809 | | 11/2017 |

* cited by examiner

METHOD FOR DRIVING PLURALITY OF PIXEL LINES AND ELECTRONIC DEVICE THEREOF

CROSS-REFERENCE TO RELATED APPLICATION

This application is based on and claims priority under 35 U.S.C. § 119 to Korean Patent Application No. 10-2018-0039381, filed on Apr. 4, 2018, in the Korean Intellectual Property Office, the disclosure of which is incorporated by reference herein its entirety.

BACKGROUND

1. Field

The disclosure relates to an electronic device including a display.

2. Description of Related Art

As information technology develops, various types of electronic devices including a display, such as a smartphone, a tablet personal computer (PC), and the like are widely being supplied.

A user may watch various pieces of content through an electronic device including a display, and may perform various functions such as shooting of a picture or a video, a game, Internet, and the like. On the other hand, when the size of the content displayed on the display is greater than the size of the display, the content may not be displayed on the display screen at once. In this case, the user may identify the content through a gesture (a scroll operation) that pushes the display in a specified direction.

The display mounted on an electronic device is gradually becoming larger and larger based on the demand of the user.

The display may include a plurality of pixels arranged in the form of a lattice. The pixels need a gate voltage and source voltage (or data voltage) to emit light, and a gate line and a source line (or data line) may be connected to each pixel to provide each of the gate voltage and source voltage.

The gate voltage may be input sequentially for each gate line. In this case, a difference in time when the gate voltage is input may occur between gate lines respectively arranged at opposite ends of a display. When the difference in time is not less than a specified level, a content distortion may occur as if a part of the screen is dragged when a user scroll a display screen. As the display becomes larger and the number of gate lines increases, the difference in time may increase and the content distortion may become worse.

For example, it is assumed that the text is output from the left area of the screen to the right area of the screen and the user scrolls the screen up and down. In this case, the start of the text, e.g., the left area of screen, may be output in an area where the first gate line is arranged; the end of the text, e.g., the right area of screen, may be output in an area where the last gate line is arranged. Because the gate voltage is first input to the first gate line, new image data by the scroll may be output to the corresponding area within a short time. However, the gate voltage may be input to the last gate line after a specified time elapses; and new image data may be output in the corresponding area with a delay. That is, new image data may be output in the corresponding area of the first gate line during the specified time; on the other hand, existing image data may still be output in the corresponding area of the last gate line. For example, the response to the scroll operation may be relatively slow at the end portion of the text. When the response to the scroll operation differs by a specified level or more between the start portion and the end portion of the text, content distortion that appears as if the end portion of the text is dragged may occur.

The content distortion may occur when the user's scroll direction is parallel to the direction of the gate line of the display. For example, when the user scrolls in the width direction in an electronic device where the gate line is arranged in the width direction, the content may be distorted in a part of the screen, for example, an area where the last gate line is arranged. For another example, even when the user scrolls in a direction (e.g., the height direction) parallel to the gate line while the user utilizes the electronic device after rotating the electronic device by 90 degrees, the content distortion may occur. For still another example, when the electronic device is a foldable electronic device capable of being folded or unfolded to the left or right, the display driver integrated circuit (DDI) may be arranged on the left or right side of the electronic device and the gate lines may be arranged in the height direction of the electronic device. In this case, when the user scrolls in the height direction (up and down directions) parallel to the direction of the gate lines, the content distortion may occur.

Due to the distortion of the content, the user may recognize the content incorrectly when performing scroll operations and may feel uncomfortable in terms of visibility.

The above information is presented as background information only to assist with an understanding of the disclosure. No determination has been made, and no assertion is made, as to whether any of the above might be applicable as prior art with regard to the disclosure.

SUMMARY

Example embodiments of the disclosure address at least the above-mentioned problems and/or disadvantages and provide at least the advantages described below. Accordingly, an example aspect of the disclosure is to provide an electronic device for addressing the above-described problem and problems brought up in this disclosure.

In accordance with an example aspect of the disclosure, an electronic device may include a display panel including a first edge extending in a first direction and a second edge extending from one end of the first edge in a second direction perpendicular to the first direction, a first group of gate lines supplying a first gate voltage to a first pixel line and supplying a third gate voltage to a third pixel line, a second group of gate lines supplying a second gate voltage to a second pixel line and supplying a fourth gate voltage to a fourth pixel line, and at least one processor electrically connected to each of the first group of gate lines and the second group of gate lines. The display panel may include a first pixel line, a second pixel line arranged at a next line of the first pixel line, a third pixel line arranged at a next line of the second pixel line, and a fourth pixel line arranged at a next line of the third pixel line. The at least one processor may be configured to control the electronic device to sequentially supply the first gate voltage and the third gate voltage to the first pixel line and the third pixel line through the first group of gate lines to output a part of specified image data and to sequentially supply the second gate voltage and the fourth gate voltage to the second pixel line and the fourth pixel line through the second group of gate lines to output another part of specified image data different from the part of the specified image data.

In accordance with another example aspect of the disclosure, an electronic device may include a display panel including a first area including a first group of pixel lines and a second area including a second group of pixel lines, a first group of gate lines supplying a gate voltage to the first group of pixel lines, a second group of gate lines supplying the gate voltage to the second group of pixel lines, at least one processor electrically connected to each of the first group of gate lines and the second group of gate lines. The at least one processor may be configured to control the electronic device to supply the gate voltage to the first group of pixel lines through the first group of gate lines at a first specified time to output at least part of specified image data and to supply the gate voltage to the second group of pixel lines through the second group of gate lines at a second specified time synchronized with the first specified time to output remaining parts of the specified image data.

In accordance with another example aspect of the disclosure, an electronic device may include a display panel including one or more first group pixel lines and one or more second group pixel lines, one or more first wires electrically connected to the one or more first group pixel lines, one or more second wires electrically connected to the one or more second group pixel lines, and a display driver integrated circuit including one or more first terminals electrically connected to the one or more first wires and one or more second terminals electrically connected to the one or more second wires. The display driver integrated circuit may be configured to sequentially drive the one or more first group pixel lines through the one or more first terminals and to sequentially drive the one or more second group pixel lines through the one or more second terminals.

Other aspects, advantages, and salient features of the disclosure will become apparent to those skilled in the art from the following detailed description, which, taken in conjunction with the annexed drawings, discloses various example embodiments of the disclosure.

BRIEF DESCRIPTION OF THE DRAWINGS

The above and other aspects, features, and advantages of certain embodiments of the disclosure will be more apparent from the following detailed description, taken in conjunction with the accompanying drawings, in which.

DETAILED DESCRIPTION

Figure 1:
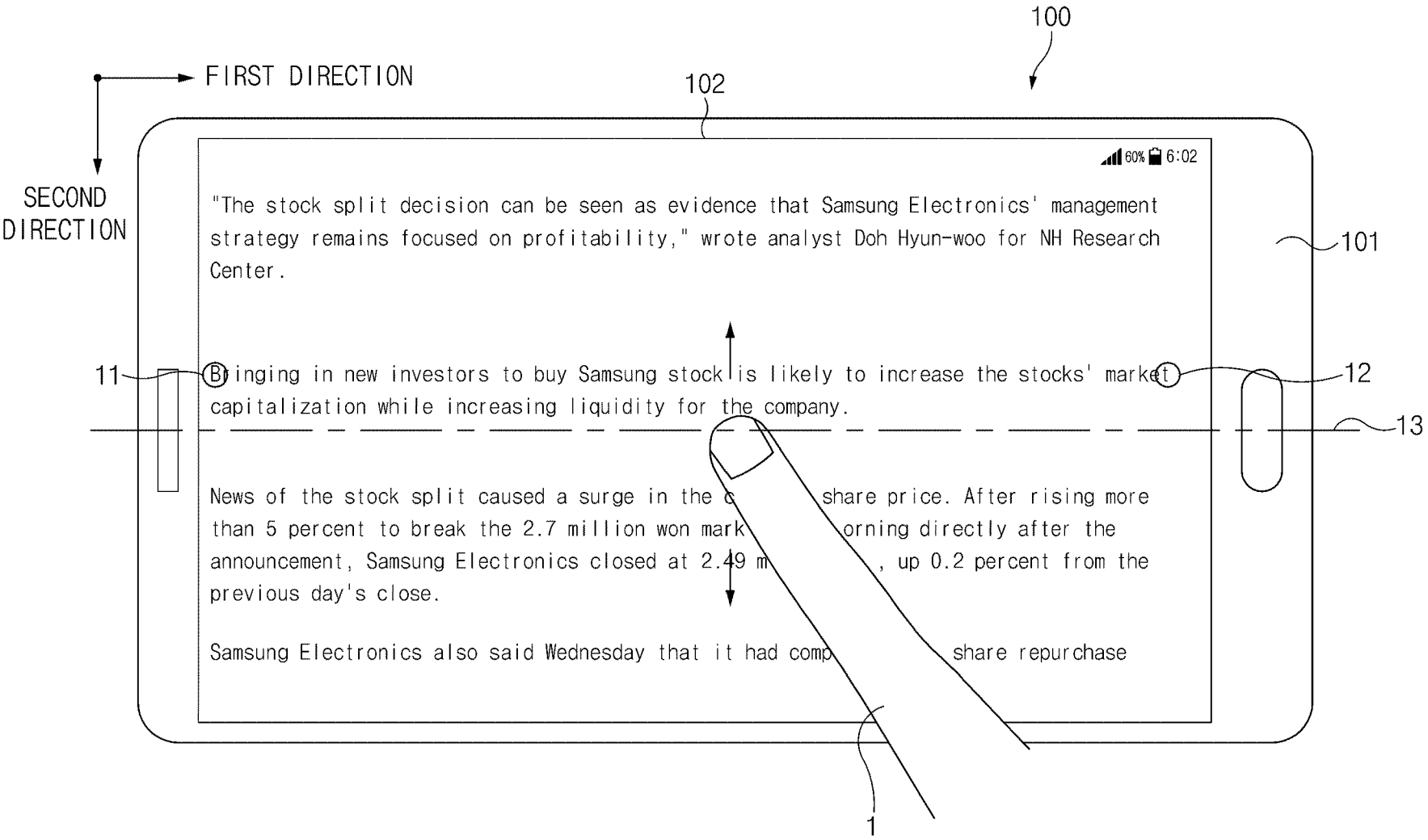
FIG. 1 is a diagram illustrating an example electronic device, according to an embodiment.

FIG. 1 illustrates an example electronic device, according to an embodiment.

Referring to FIG. 1, an electronic device 100 may include housing 101. The housing 101 may form the appearance of the electronic device 100, and may protect internal components of the electronic device 100 from external impact.

According to an embodiment, the electronic device 100 may include a display 102. The display 102 may be exposed to the outside through one surface (e.g., a front surface) of the housing 101. According to an embodiment, the display 102 may output content (e.g., a text, an image, a video, an icon, a widget, or a symbol) or may receive an input (e.g., a touch input or an electronic pen input from a user 1).

According to an embodiment, the screen of the electronic device 100 may be output in landscape mode as illustrated in FIG. 1. The landscape mode may be a screen mode in which the width of the output screen is longer than the height. According to an embodiment, the screen of the electronic device 100 may be output in portrait mode (not shown). The portrait mode may be a screen mode in which the height of the output screen is longer than the width. According to various embodiments, the screen mode may be changed under control of a user and may be automatically changed based on at least one sensor that senses the posture (orientation) of the electronic device 100.

According to an embodiment, the display 102 may include a display panel in which a plurality of pixels are arranged in a grid. In an embodiment, each of the plurality of pixels may receive a gate voltage and a data voltage, both of which have a specified magnitude, to emit light. When the plurality of pixels emit light, the electronic device 100 may output a specified screen on the display 102 to provide the user 1 with the specified screen.

According to an embodiment, the electronic device 100 may include a plurality of gate lines providing the plurality of pixels with the gate voltage and a plurality of data lines providing the plurality of pixels with the data voltage. According to an embodiment, the plurality of gate lines and the plurality of data lines may be arranged on the display 102 in directions perpendicular to each other.

For example, the plurality of gate lines may be arranged in a direction parallel to the second direction illustrated in FIG. 1, and the plurality of data lines may be arranged in a direction parallel to the first direction illustrated in FIG. 1. For another example, when the electronic device 100 is a foldable electronic device folded with respect to a first dashed line 13, the location of a DDI for driving the display 102 may be limited. In this case, due to the limited location of the DDI, the plurality of gate lines may be arranged in a direction parallel to the first direction, and the plurality of data lines may be arranged in a direction parallel to the second direction. In the following description of FIG. 1, it is assumed, for example, and without limitation, that the plurality of gate lines are arranged in a direction parallel to the second direction. However, embodiments are not limited thereto.

According to an embodiment, the electronic device 100 may output specified image data by sequentially providing the gate voltage to each of the plurality of gate lines. According to an embodiment, the electronic device 100 in which a plurality of gate lines are arranged in a direction parallel to the second direction may provide the gate voltage to the gate line corresponding to a first point 11 at a first time t1 and may provide the gate voltage to the gate line corresponding to a second point 12 at a second time t2. That is, the electronic device 100 may output the specified content, e.g., at least part of the image corresponding to the alphabet to the first point 11 at the first time t1, and may output the specified content, e.g., at least part of the image corresponding to the alphabet 't', to the second point 12 at the second time t2.

In an embodiment, the time difference (t2−t1) between the first time and the second time may be shorter than the specified time. According to an embodiment, the specified time may be half of the time that the electronic device 100 outputs one frame. For example, when the electronic device 100 is configured to output 60 frames per second, the specified time may be approximately 8.3 ms.

According to an embodiment, the electronic device 100 may move the content and the screen, both of which are output in response to the input of the user 1, in a specified direction (e.g., the first direction or the second direction). That is, when the user 1 touches the display 102 and then pushes in the specified direction, the electronic device 100 may collectively move the location of the content output on the display 102 in the specified direction. For example, in the state illustrated in FIG. 1, when the user 1 scrolls in the direction opposite to the second direction, the electronic device 100 outputs the at least part of the image corresponding to the alphabet 'c' at the first point 11 and may output at least part of the image corresponding to the blank space at the second point 12.

As such, the electronic device 100 may provide the effect of moving the screen, which has been output through the display 102, in the specified direction in response to the input of the user 1. It is understood that an operation in which the user touches the display 102 and then pushes in the specified direction is a scroll operation.

According to various embodiments, the extent (e.g., movement speed or movement distance) to which the screen is moved in the specified direction in response to the scroll operation of the user 1 may vary based on the scroll operation. For example, when the user 1 pushes the display 102 at a relatively high speed, the movement speed of the screen may be relatively fast. For another example, when the user 1 performs the scroll operation over a relatively large area of the area of the display 102, the movement distance of the screen may be relatively long.

According to an embodiment, the direction in which the user 1 scrolls may be parallel to a plurality of gate lines. For example, each of the plurality of gate lines may be arranged in a direction parallel to the second direction, and the user 1 may scroll in a direction parallel to the second direction. In another embodiment, the direction in which the user 1 scrolls may be perpendicular to a plurality of gate lines. For example, each of the plurality of gate lines may be arranged in a direction parallel to the second direction, and the user 1 may scroll in the first direction perpendicular to the second direction.

According to an embodiment, as described above, because the time difference (t2−t1) between the first time t1 and the second time t2 is shorter than the specified time, the time difference between a time required to output new image data to the first point 11 and a time required to output new image data to the second point 12 by the scroll operation of the user 1 may be shorter than the specified time. For example, when the user 1 scrolls in a direction parallel to the plurality of gate lines, for example, in a direction opposite to the second direction, the time difference between the time at which the at least part of the image corresponding to the alphabet 'c' is output at the first point 11 and the time at which the at least part of the image corresponding to an empty space is output at the second point 12 may be shorter than the specified time. In this case, a phenomenon that the screen of the electronic device 100 is dragged, which is recognized by the user 1 may be reduced. Accordingly, when the user 1 scrolls the screen, the distortion of the content displayed on the display 102 may be less than the specified level.

In this disclosure, the description given with reference to FIG. 1 may be applied to components which have the same reference numerals as those of the electronic device 100 illustrated in FIG. 1.

Figure 2:
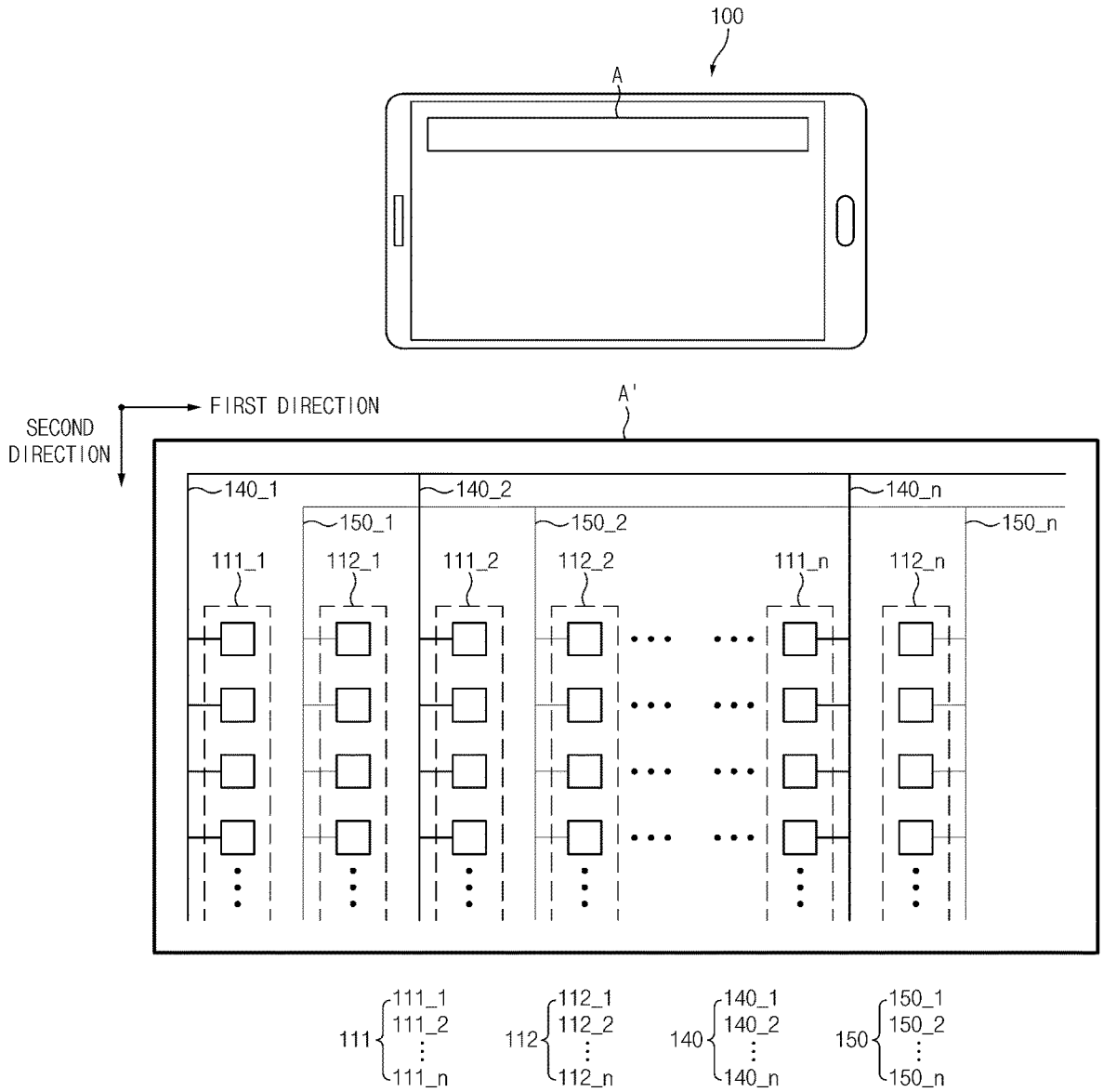
FIG. 2 is a diagram illustrating an example electronic device and an enlarged view thereof, according to an embodiment.

FIG. 2 is a diagram illustrating an example electronic device and an enlarged view thereof, according to an embodiment.

Referring to FIG. 2, an area A' enlarging an area A of the electronic device 100 may represent the partial area of a display. The area A' may include a first group of pixel lines 111, a second group of pixel lines 112, a first group of gate lines 140, and a second group of gate lines 150. According to various embodiments, the area A' may further include a component not illustrated in FIG. 2, or a part of the illustrated components may be omitted in the area A'. For example, a plurality of data lines respectively connected to pixels may be included.

According to an embodiment, the first group of pixel lines 111 may include a plurality of pixels lines (e.g., 111_1, 111_2, . . . **111_*n*). According to an embodiment, each of the plurality of pixel lines may include a plurality of pixels; and the plurality of pixel lines may be electrically connected to the first group of gate lines 140, respectively. For example, the 1-1th pixel line 111_1 may be electrically connected to the 1-1th gate line 140_1, and the 1-2th pixel line 111_2 may be electrically connected to the 1-2th gate line 140_2**.

According to an embodiment, the second group of pixel lines 112 may include a plurality of pixels lines (e.g., 112_1, 112_2, . . . **112_*n*). According to an embodiment, each of the plurality of pixel lines may include a plurality of pixels; and the plurality of pixel lines may be electrically connected to the second group of gate lines 150, respectively. For example, the 2-1th pixel line 112_1 may be electrically connected to the 2-1th gate line 150_1, and the 2-2th pixel line 112_2 may be electrically connected to the 2-2th gate line 150_2**.

According to an embodiment, the first group of gate lines 140 may be sequentially arranged in a first direction. According to an embodiment, the first group of gate lines 140 may provide a gate voltage to the first group of pixel lines 111, respectively. The first group of gate lines 140 may sequentially provide a gate voltage to pixel lines, respectively. For example, the first group of gate lines 140 may provide a gate voltage to the first group of pixel lines 111, sequentially from the 1-1th gate line 140_1 based on the first direction. For another example, the first group of gate lines 140 may provide a gate voltage to the first group of pixel lines 111, sequentially from the 1-nth gate line **140_*n*** based on a direction opposite to the first direction.

According to an embodiment, the second group of gate lines 150 may be sequentially arranged in a first direction. According to an embodiment, the second group of gate lines 150 may provide a gate voltage to the second group of pixel lines 112, respectively. For example, the second group of gate lines 150 may sequentially provide a gate voltage to the second group of pixel lines 112 in a direction the same as the direction of the first group of gate lines 140, respectively. For another example, the second group of gate lines 150 may sequentially provide a gate voltage to the second group of pixel lines 112 in a direction opposite to the direction of the first group of gate lines 140, respectively.

According to various embodiments, the arrangement of the first group of pixel lines 111 and the second group of pixel lines 112 and the arrangement of the first group of gate lines 140 and the second group of gate lines 150 are not limited to that illustrated in FIG. 2. For example, the arrangement order of the first group of gate lines 140 and the second group of gate lines 150 may be different from that illustrated in FIG. 2. For another example, each pixel line included in the first group of pixel lines 111 and the second group of pixel lines 112 may be arranged differently from the arrangement illustrated in FIG. 2.

In this disclosure, the description given with reference to FIG. 2 may be applied to components which have the same reference numerals as those of the electronic device 100 illustrated in FIG. 2.

Figure 3:
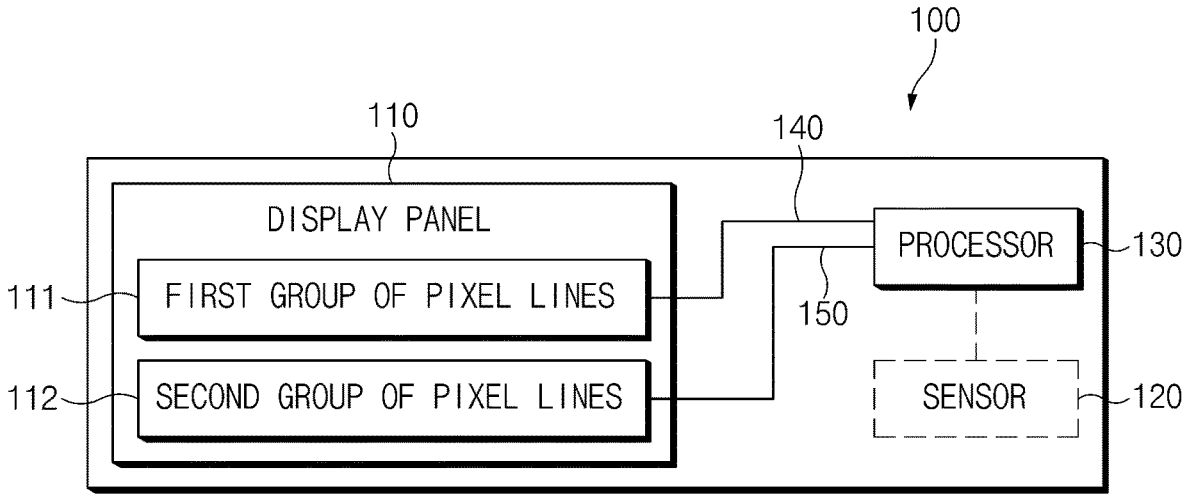
FIG. 3 is a block diagram illustrating an example electronic device, according to an embodiment.

FIG. 3 is a block diagram illustrating an example electronic device, according to an embodiment.

Referring to FIG. 3, the electronic device 100 may include a display panel 110, a sensor 120, a processor (e.g., including processing circuitry) 130, the first group of gate lines 140, and the second group of gate lines 150. According to various embodiments, the electronic device 100 may further include a component not illustrated in FIG. 3, or a part of the components illustrated in FIG. 3 may be omitted. For example, the electronic device 100 may not include the sensor 120. In another embodiment, the electronic device 100 may include data lines for providing a data voltage to the first group of pixel lines 111 and the second group of pixel lines 112. For another example, the electronic device 100 may further include a DDI distinguished from the processor 130.

The display panel 110 may include a plurality of pixels. For example, the display panel 110 may include the first group of pixel lines 111 and the second group of pixel lines 112. In an embodiment, the display panel 110 may output the specified image data through the first group of pixel lines 111 and the second group of pixel lines 112.

According to an embodiment, the first group of pixel lines 111 and the second group of pixel lines 112 may receive the gate voltage through different gate lines. For example, the first group of pixel lines 111 may receive the gate voltage through the first group of gate lines 140, and the second group of pixel lines 112 may receive the gate voltage through the second group of gate lines 150.

The first group of gate lines 140 may include a plurality of gate lines. Each gate line may be electrically connected to pixel lines included in the first group of pixel lines 111. Each of the gate lines may sequentially provide a gate voltage to the pixel lines.

The second group of gate lines 150 may include a plurality of gate lines. Each gate line may be electrically connected to pixel lines included in the second group of pixel lines 112. Each of the gate lines may sequentially provide a gate voltage to the pixel lines.

According to an embodiment, the first group of gate lines 140 and the second group of gate lines 150 may be arranged alternately with each other. In another embodiment, the first group of gate lines 140 and the second group of gate lines 150 may be arranged in areas, which are distinguished from each other, of a display area.

The sensor 120 may sense the posture (orientation) of the electronic device 100. According to various embodiments, the sensor 120 may sense whether a part of the electronic device 100 is parallel to the ground. The sensor 120 may include, for example, and without limitation, at least one of a gyro sensor, an acceleration sensor, a geomagnetic sensor, or the like.

The processor 130 may include various processing circuitry and be electrically connected with the components included in the electronic device 100 and may execute operations or data processing associated with control and/or communication of the components. For example, the processor 130 may provide a gate voltage to the pixels at a specified time (e.g., specified timing) through the first group of gate lines 140 or the second group of gate lines 150. The processor 130 may provide the gate voltage to the pixels to output the specified image data to the display panel 110. For another example, the processor 130 may determine the posture of the electronic device 100 using the sensor 120. The processor 130 may output the screen to be output to the display, in landscape mode or portrait mode based on the determined posture of the electronic device 100.

According to various embodiments, the processor 130 may include, for example, and without limitation, at least one of an AP, a DDI, a sensor hub, or the like.

In this disclosure, the description given with reference to FIG. 3 may be applied to components which have the same reference numerals as those of the electronic device 100 illustrated in FIG. 3.

Figure 4A:
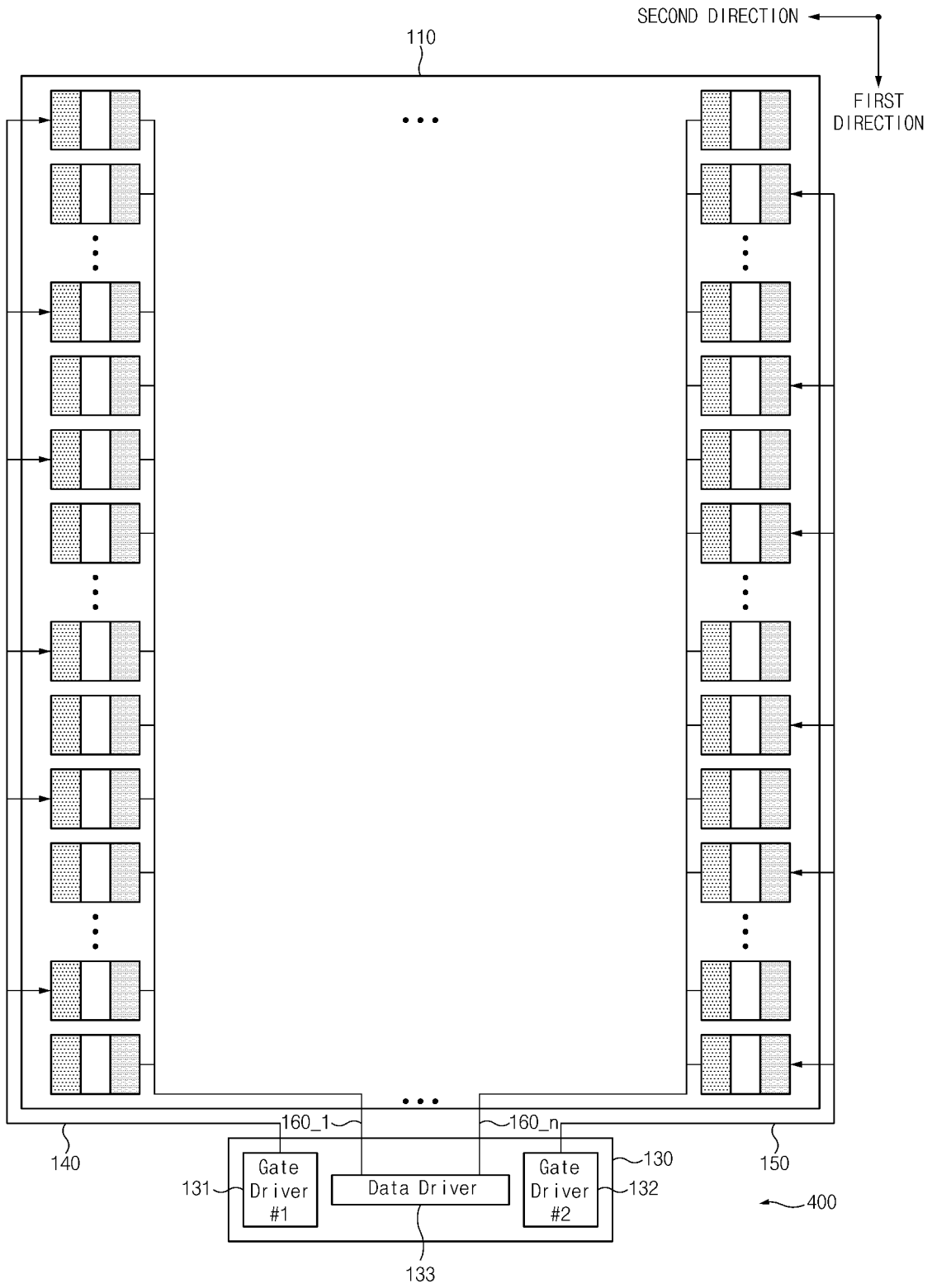
FIG. 4A is a diagram illustrating an example internal structure of an example electronic device, according to an embodiment.

FIG. 4A is a diagram illustrating an example internal structure of an example electronic device, according to an embodiment.

Referring to FIG. 4A, the internal structure of an electronic device 400 capable of reducing the difference between a point in time when image data is output to one end of the display panel 110 and a point in time when image data is output to the other end of the display panel 110 is illustrated. The electronic device 400 may include the display panel 110, the processor 130, the first group of gate lines 140, the second group of gate lines 150, and data lines 160_1 to **160_*n***.

According to an embodiment, the display panel 110 may include a first edge extending in a first direction and a second edge extending from one end of the first edge in a second direction perpendicular to the first direction. For example, the display panel 110 may, for example, and without limitation, be in the form of a substantially rectangular shape, for example, and without limitation, a rectangle, a rounded rectangle, or the like.

According to an embodiment, a plurality of pixels may be arranged in the display panel 110 in a grid. For example, some of the plurality of pixels are omitted in FIG. 4A. However, the plurality of pixels are arranged in the second direction to form at least one pixel line, and the at least one or more pixel lines may be arranged in the first direction.

In the descriptions of FIG. 4A, the pixel lines formed such that a plurality of pixels are arranged in the second direction may be referred to as "first to 2n-th pixel lines" in order from the uppermost end. Moreover, the odd-numbered pixel lines of the first to 2n-th pixel lines may be referred to as the first group of pixel lines; the even-numbered pixel lines thereof may be referred to as the second group of pixel lines. For example, the first group of pixel lines may include a first pixel line and a third pixel line, and the second group of pixel lines may include a second pixel line and a fourth pixel line.

According to an embodiment, the processor 130 may include various processing circuitry, including, for example, and without limitation, a first gate driver 131, a second gate driver 132, and a data driver 133. In an embodiment, the first gate driver 131 may provide the first group of pixel lines with a gate voltage through the first group of gate lines 140. In an embodiment, the second gate driver 132 may provide the second group of pixel lines with a gate voltage through the second group of gate lines 150. In an embodiment, the data driver 133 may provide the first group of pixel lines and the second group of pixel lines with a data voltage through the data lines 160_1 to 160_*n*.

According to an embodiment, the processor 130 may include various processing circuitry and control the first gate driver 131, the second gate driver 132, and the data driver 133 to output the specified image data on a display. For example, the processor 130 may provide the gate voltage to the pixel lines in the specified order. When the gate voltage exceeding the specified voltage is supplied, a transistor included in the pixel may be changed to be in an on-state. When the transistors included in one pixel line (e.g., the first pixel line) are in an on-state, the processor 130 may sequentially provide a data voltage to each data line. When the data voltage is provided, each pixel may emit light sequentially as current flows through the transistors that are in the on-state.

According to an embodiment, the processor 130 may control the first gate driver 131 such that a gate voltage is provided in the order in which the first group of gate lines 140 are arranged and may control the second gate driver 132 such that a gate voltage is provided in the order in which the second group of gate lines 150 are arranged.

In an embodiment, the processor 130 may provide a gate voltage to the first group of gate lines 140 and then may provide the gate voltage to the second group of gate lines 150. For example, the processor 130 may output image data to the odd-numbered pixel line from the top to the bottom of the display panel 110, and then may output image data to the even-numbered pixel line. In another embodiment, the processor 130 may provide a gate voltage to the second group of gate lines 150 and then may provide the gate voltage to the first group of gate lines 140.

According to an embodiment, the processor 130 may sequentially provide the gate voltage to the gate lines included in the first group of gate lines 140 or the gate lines included in the second group of gate lines 150. For example, the processor 130 may sequentially provide the gate voltage to the first group of gate lines 140 based on the first direction or a direction opposite to the first direction. For another example, the processor 130 may sequentially provide the gate voltage to the second group of gate lines 150 based on the first direction or a direction opposite to the first direction.

As described above, the electronic device 400 may first provide the gate voltage to the odd-numbered gate lines or may first provide the gate voltage to the even-numbered gate lines. As such, the electronic device 400 may reduce the time difference between a point in time when image data is output at one end of the display panel 110 and a point in time when image data is output at the other end of the display panel 110 and may reduce the distortion of content displayed on the display so as to be in a specified level or less.

Figure 4B:
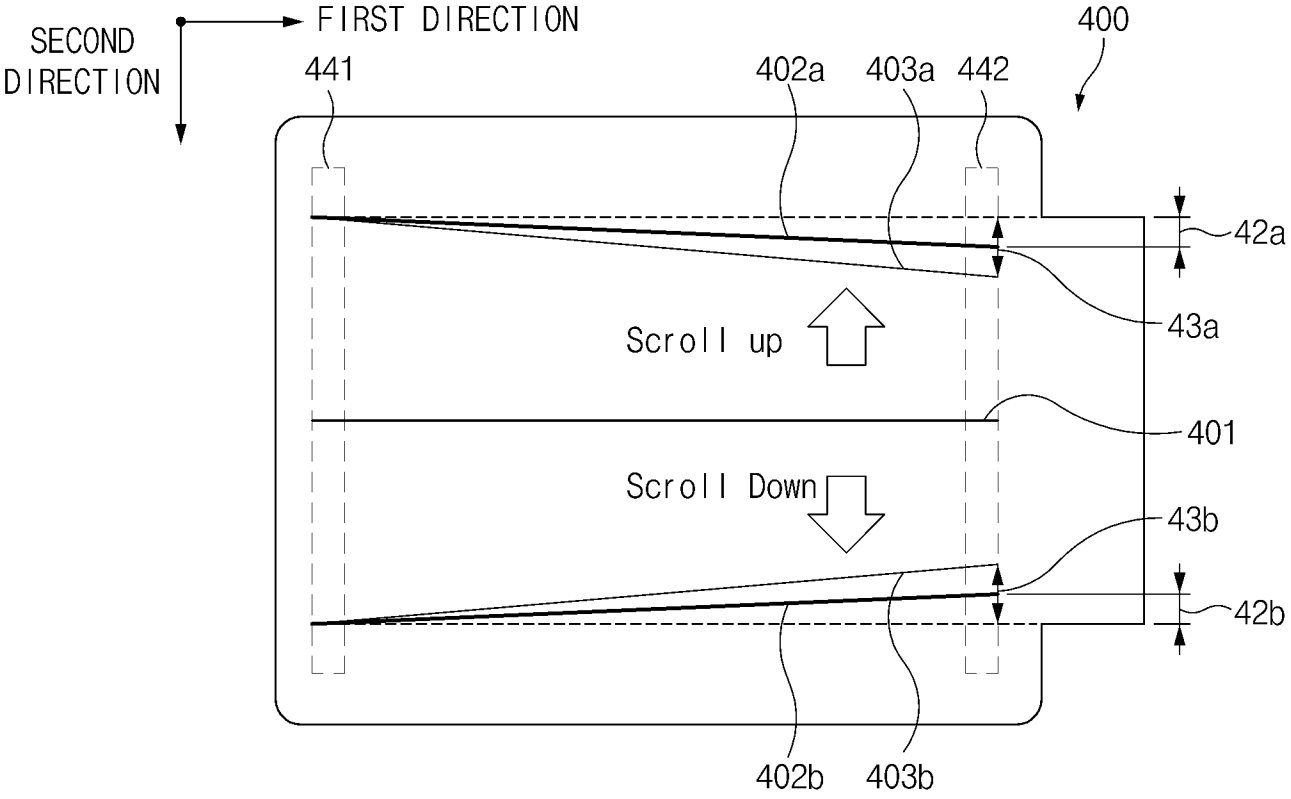
FIG. 4B is a diagram illustrating an example extent to which content may be distorted due to a scroll operation in an electronic device, according to various embodiments.

FIG. 4B is a diagram illustrating an example extent to which a screen is dragged due to a scroll operation in an example electronic device, according to various embodiments.

Referring to FIG. 4B, a first line 401 may represent at least one content, for example, and without limitation, a text or an image, which is displayed on a display before the user scrolls. A second line 402*a* and a fourth line 402*b* may illustrate that at least one content is output in the electronic device 400 illustrated in FIG. 4A while the user scrolls. A third line 403*a* and a fifth line 403*b* may illustrate that at least one content is output in an electronic device different from the electronic device 400 illustrated in FIG. 4A while the user scrolls. In the description of FIG. 4B, the electronic device 400 is referred to as the first electronic device 400, and the other electronic device may be referred to as a second electronic device.

According to an embodiment, the first electronic device 400 may sequentially provide a gate voltage to the odd-numbered pixel line from a first output area 441 to a second output area 442, and then may sequentially provide the gate voltage to the even-numbered pixel line from the first output area 441 to the second output area 442. In this case, the difference in time from a point in time when the first electronic device 400 outputs the specified image data to the first output area 441 to a point in time when the first electronic device 400 outputs the specified image data to the second output area 442 may be the time T1. In an embodiment, the time required for the first electronic device 400 to output the specified image data to the entire display area may be twice the time T1. For example, the first electronic device 400 may output a part of the specified image data from the first output area 441 to the second output area 442, using the odd-numbered pixel line during the first time T1. The first electronic device 400 may output a part of the specified image data from the first output area 441 to the second output area 442, using the even-numbered pixel line during the next time T1.

According to an embodiment, the second electronic device may sequentially provide a gate voltage from the first output area 441 to the second output area 442 in the first direction. The difference in time from a point in time when the second electronic device outputs the specified image data to the first output area 441 to a point in time when the second electronic device outputs the specified image data to the second output area 442 may be a time T2. According to an embodiment, because the second electronic device outputs the specified image data over the entire display area during the time T2, the time T2 may be approximately twice the time T1.

According to an embodiment, when the user scrolls in a direction opposite to the second direction, the phenomenon that the screen is dragged may occur in the first electronic device 400 and the second electronic device. For example, referring to the third line 403*a*, until the T2 time elapses after the second electronic device outputs new image data to the first output area 441 in response to the scroll operation of the user, the second electronic device may output the existing image data to the second output area 442. Accordingly, as illustrated in FIG. 4B, in the third line 403*a*, the difference in height between the first output area 441 and the second output area 442 may be as high as a second height 43*a*.

For example, referring to the second line 402*a*, until the T1 time elapses after the first electronic device 400 outputs new image data to the first output area 441 in response to the scroll operation of the user, the first electronic device 400 may output the existing image data to the second output area 442, not the new image data. Accordingly, as illustrated in FIG. 4B, in the second line 402*a*, the difference in height between the first output area 441 and the second output area 442 may be as high as a first height 42*a*. Because the first height 42*a* is about half the second height 43*a*, the first electronic device 400 may reduce the phenomenon that the screen is dragged, compared to the second electronic device.

According to an embodiment, when the user scrolls in the second direction, the phenomenon that the screen is dragged may occur in the first electronic device 400 and the second electronic device. Referring to the fourth line 402*b* and the fifth line 403*b*, the extent to which the screen is dragged in the first electronic device 400 may be as height as a third height 42*b*, and the extent to which the screen is dragged in the second electronic device may be as height as a fourth height 43*b*. Because the third height 42*b* is about half the fourth height 43*b*, the first electronic device 400 may reduce the phenomenon that the screen is dragged, to a specified level or less compared to the second electronic device.

Figure 4C:
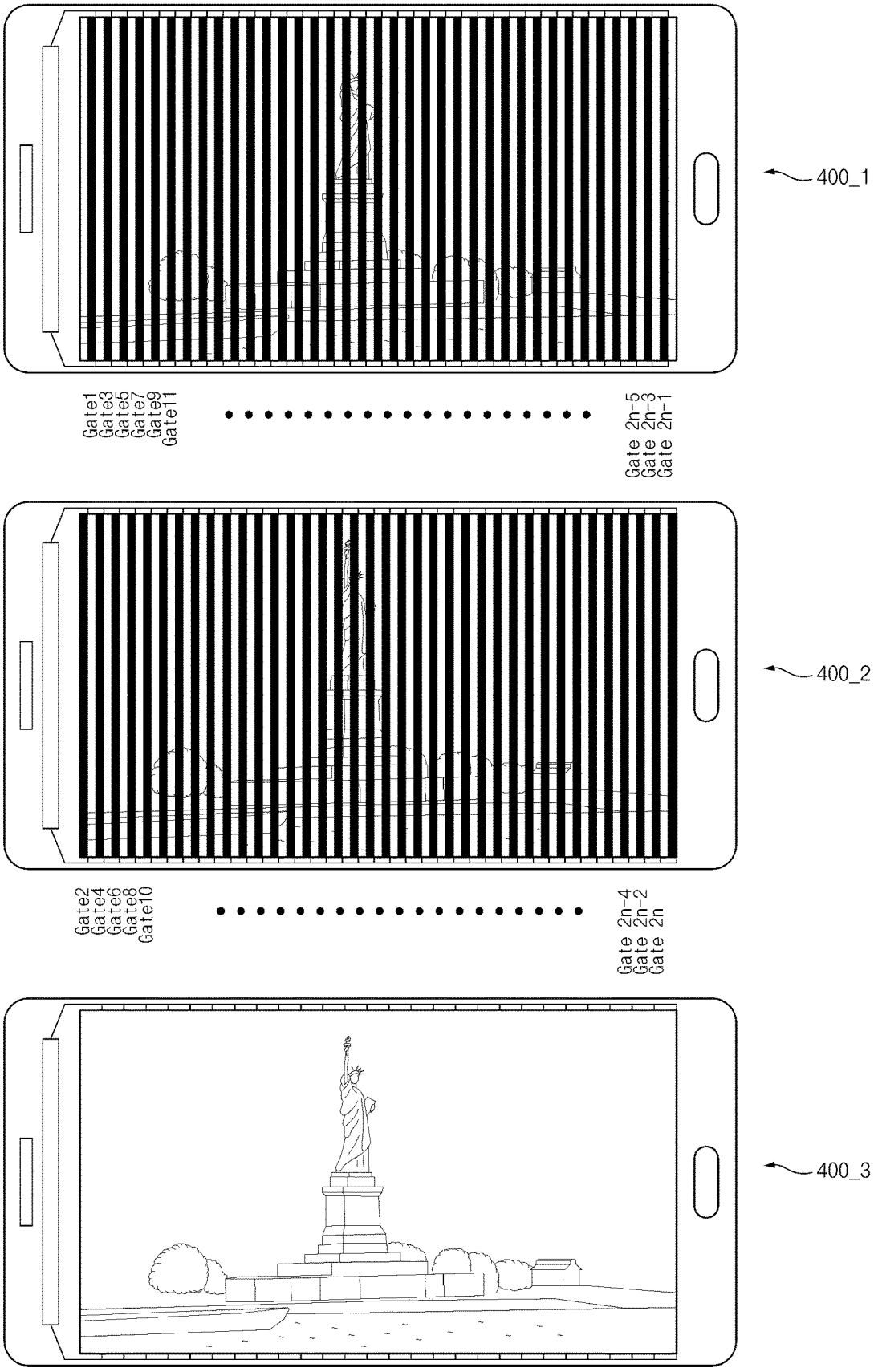
FIG. 4C is a diagram illustrating an example procedure in which an electronic device outputs a specified image, according to an embodiment.

FIG. 4C is a diagram illustrating an example procedure in which an example electronic device outputs a specified image, according to an embodiment.

Referring to FIG. 4C, electronic devices 400_1, 400_2 and 400_3 may divide one frame of specified image data into two steps to output the divided result. For example, the electronic device 400_1, 400_2 and 400_3 may output a part of the specified image data to odd-numbered pixel lines and then may output the remaining parts of the specified image data to even-numbered pixel lines. The electronic device 400_1 may illustrate a state where the part of the image data assigned to the odd-numbered pixel line is output. The electronic device 400_2 may illustrate a state where the remaining parts of the image data assigned to the even-numbered pixel line are output. The electronic device 400_3 may illustrate a state where the part of the image data assigned to the entire pixel line is output.

According to an embodiment, the electronic device 400_1 may provide a gate voltage to the odd-numbered pixel line through a first group of gate lines (e.g., the odd-numbered gate lines) during the first time to output a part of the assigned image data.

According to an embodiment, the electronic device 400_2 may provide a gate voltage to the even-numbered pixel line through a second group of gate lines (e.g., the even-numbered gate lines) during the second time after the first time to output the remaining parts of the assigned image data.

According to an embodiment, the first time and the second time may be substantially the same as each other. In an embodiment, the sum of the first time and the second time may be substantially the same as the third time required for an electronic device to provide a gate voltage all the pixel lines from the first pixel line to the 2n-th pixel line and to output the specified image data.

Figure 5:
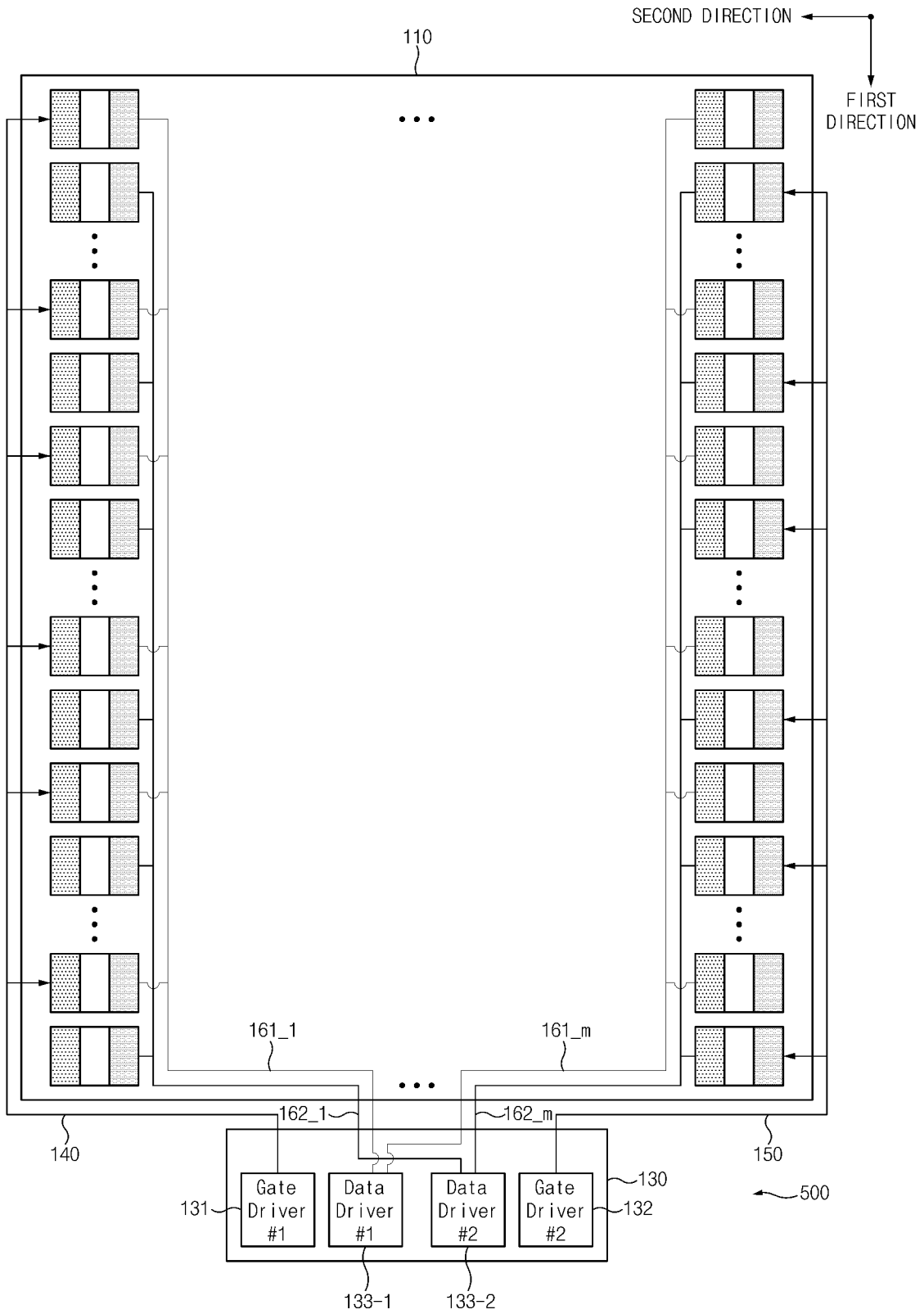
FIG. 5 is a diagram illustrating an example internal structure of an example electronic device, according to another embodiment.

FIG. 5 is a diagram illustrating an example internal structure of an example electronic device, according to another embodiment.

Referring to FIG. 5, the internal structure of an electronic device 500 is capable of reducing the difference in time from a point in time when image data is output to one end of the display panel 110 to a point in time when image data is output to the other end of the display panel 110 is illustrated. The electronic device 500 may include the display panel 110, the processor 130, the first group of gate lines 140, the second group of gate lines 150, first group of data lines 161_1 to 161_*m*, and second group of data lines 162_1 to 162_*m*. In the descriptions of FIG. 5, the description duplicated with reference to FIG. 4A may not be repeated here.

In the descriptions of FIG. 5, the pixel lines formed such that a plurality of pixels are arranged in the second direction may be referred to as "first to 2n-th pixel lines" in order from the uppermost end. Moreover, the odd-numbered pixel lines of the first to 2n-th pixel lines may be referred to as the first group of pixel lines; the even-numbered pixel lines thereof may be referred to as the second group of pixel lines.

According to an embodiment, the processor 130 may include various processing circuitry including, for example, and without limitation, the first gate driver 131, the second gate driver 132, a first data driver 133-1, and a second data driver 133-2. In an embodiment, the first data driver 133-1 may provide a data voltage to the first group of pixel lines through the first group of data lines 161_1 to 161_*m*. In an embodiment, the second data driver 133-2 may provide a data voltage to the second group of pixel lines through the second group of data lines 162_1 to 162_*m*.

According to an embodiment, the processor 130 may control the first gate driver 131, the second gate driver 132, the first data driver 133-1, and the second data driver 133-2 to output the specified image data on a display.

According to an embodiment, the processor 130 may drive the first gate driver 131 at the first specified time (e.g., first timing) to provide a gate voltage to the first group of pixel lines; the processor 130 may drive the second gate driver 132 at the second specified time (e.g., second timing) to provide a gate voltage to the second group of pixel lines. In an embodiment, the second specified time may be synchronized with the first specified time. For example, the second specified time may be synchronized at the same time as the first specified time.

According to an embodiment, the processor 130 may drive the first gate driver 131 and the second gate driver 132 at the same time to provide the gate voltage to a pixel line included in the first group of pixel lines and a pixel line included in the second group of pixel lines. For example, the processor 130 may provide the gate voltage to an odd-numbered pixel line and an even-numbered pixel line at the same time. For example, the processor 130 may provide the gate voltage to the first pixel line and the second pixel line at the same time and may provide the gate voltage to the 2n−1th pixel line and the 2n-th pixel line at the same time.

According to an embodiment, it may be understood that the gate voltage is provided to two pixel lines at the same time when the gate voltage is provided to a pixel line included in the first group of pixel lines and a pixel line included in the second group of pixel lines at the same time. For example, the gate voltage may be provided to the first pixel line and the second pixel line at the same time.

According to an embodiment, when the gate voltage is provided to the first pixel line and the second pixel line, the processor 130 may sequentially provide a data voltage to pixels included in the first pixel line, using the first data driver 133-1 and may sequentially provide a data voltage to pixels included in the second pixel line, using the second data driver 133-2. In this case, two pixel lines may sequentially emit at the same time.

As described above, the electronic device 500 may provide the gate voltage to the odd-numbered gate lines and the even-numbered gate lines at the same time. As such, the electronic device 500 may reduce the time from a point in time when image data is output at one end of the display panel 110 to a point in time when image data is output at the other end of the display panel 110 and may reduce the distortion of content displayed on the display so as to be in a specified level or less. According to an embodiment, the extent to which the screen is dragged due to a scroll operation in the electronic device 500 may be the same as or similar to that of the second line and fourth line illustrated in FIG. 4B.

Figure 6A:
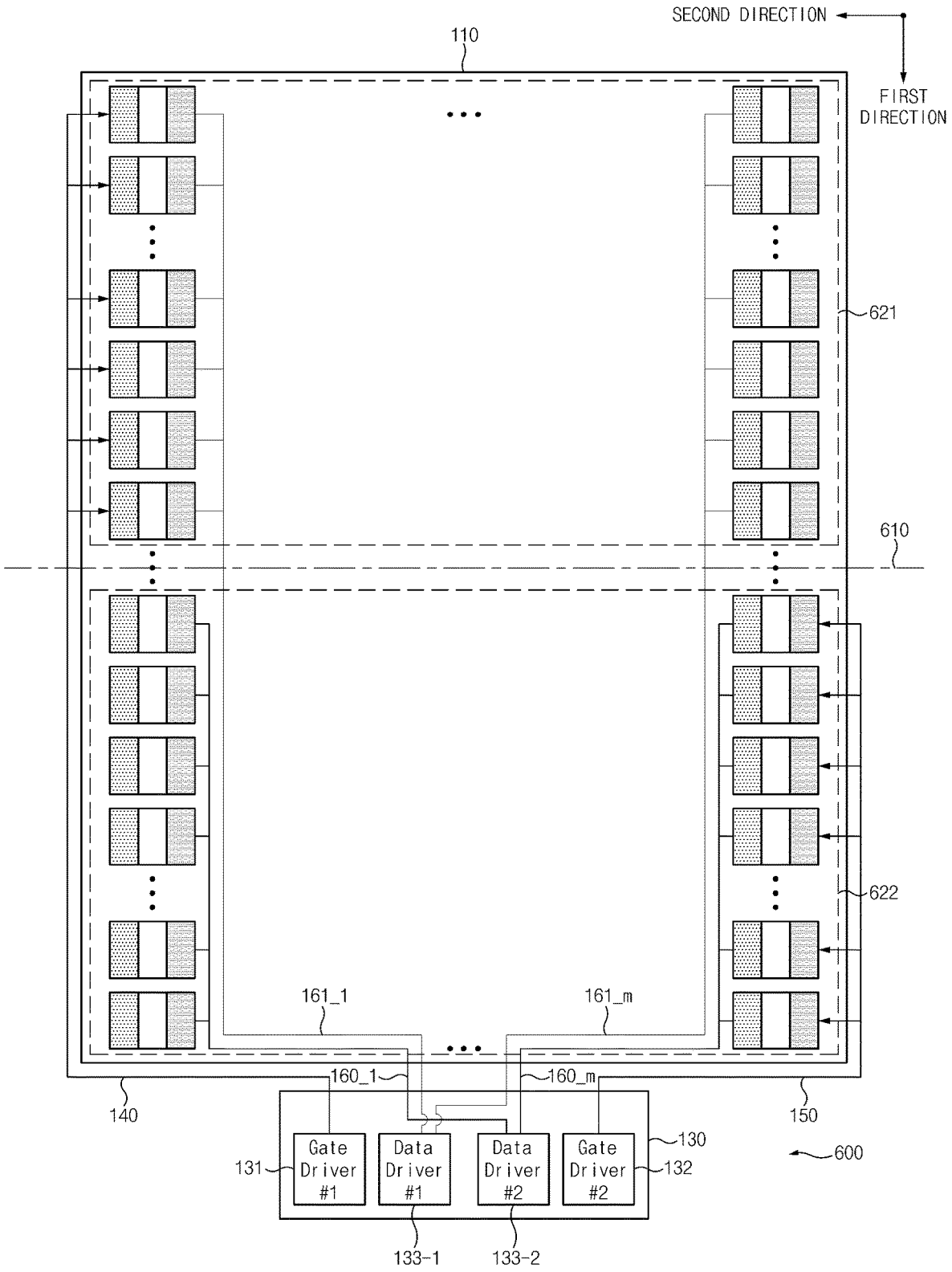
FIG. 6A is a diagram illustrating an example internal structure of an example electronic device, according to still another embodiment.

FIG. 6A is a diagram illustrating an example internal structure of an example electronic device, according to still another embodiment.

Referring to FIG. 6A, the internal structure of an electronic device 600 capable of reducing a difference in time from a point in time when image data is output to one end of the display panel 110 to a point in time when image data is output to the other end of the display panel 110 is illustrated. The electronic device 600 may include the display panel 110, the processor 130, the first group of gate lines 140, the second group of gate lines 150, the first group of data lines 161_1 to **161_*m*, and the second group of data lines 162_1 to 162_*m*. In the descriptions of FIG. 6A, the description duplicated with reference to FIG. 4**A may not be repeated here.

According to an embodiment, the display panel 110 may include a first edge extending in a first direction, a second edge extending from one end of the first edge in a second direction perpendicular to the first direction, and a third edge extending from the other end of the first edge in the second direction. For example, the display panel 110 may be in the form of a substantially rectangular shape, for example, a rectangle or a rounded rectangle. There may be a virtual center line 610 that bisects the display panel 110 between the second edge and the third edge.

According to an embodiment, the display panel 110 may be divided into a first area 621 from the second edge to the center line 610 and a second area 622 from the center line 610 to the third edge. According to an embodiment, a first group of pixel lines may be arranged in the first area 621 and a second group of pixel lines may be arranged in the second area 622. The first group of pixel lines and the second group of pixel lines may be arranged in the display panel 110 in a grid.

In the descriptions of FIG. 6, the pixel lines formed such that a plurality of pixels are arranged in the second direction may be referred to as "first to 2n-th pixel lines" in order from the uppermost end. For example, the first to nth pixel lines may be arranged in the first area 621, and the n+1th to 2n-th pixel lines may be arranged in in the second area 622.

According to an embodiment, the processor 130 may include the first gate driver 131, the second gate driver 132, the first data driver 133-1, and the second data driver 133-2. In an embodiment, the first gate driver 131 may provide the first group of pixel lines with a gate voltage through the first group of gate lines 140. In an embodiment, the second gate driver 132 may provide the second group of pixel lines with a gate voltage through the second group of gate lines 150. In an embodiment, the first data driver 133-1 may provide a data voltage to pixels included in the first group of pixel lines through the first group of data lines 161_1 to **161_*m*. In an embodiment, the second data driver 133-2 may provide a data voltage to pixels included in the second group of pixel lines through the second group of data lines 162_1 to 162_*m***.

According to an embodiment, the processor 130 may control the first gate driver 131, the second gate driver 132, the first data driver 133-1, and the second data driver 133-2 to output the specified image data on a display.

According to an embodiment, the processor 130 may control the first gate driver 131 such that a gate voltage is provided in the order in which the first group of gate lines 140 are arranged and may control the second gate driver 132 such that a gate voltage is provided in the order in which the second group of gate lines 150 are arranged.

According to an embodiment, the processor 130 may drive the first gate driver 131 at the first specified time to provide a gate voltage to the first group of pixel lines; the processor 130 may drive the second gate driver 132 at the second specified time to provide a gate voltage to the second group of pixel lines. In an embodiment, the second specified time may be synchronized with the first specified time. For example, the second specified time may be synchronized at the same time as the first specified time.

According to an embodiment, the processor 130 may drive the first gate driver 131 and the second gate driver 132 at the same time to provide the gate voltage to a pixel line included in the first group of pixel lines and a pixel line included in the second group of pixel lines. For example, the processor 130 may simultaneously provide a gate voltage to the pixel line arranged in the first area 621 and the pixel line arranged in the second area 622. For example, the processor 130 may provide the gate voltage to the first pixel line and the n+1th pixel line at the same time and may provide the gate voltage to the nth pixel line and the 2nth pixel line at the same time.

According to an embodiment, it may be understood that the gate voltage is provided to two pixel lines at the same time when the gate voltage is provided to a pixel line included in the first group of pixel lines and a pixel line included in the second group of pixel lines at the same time. For example, the gate voltage may be provided to the first pixel line and the n+1th pixel line at the same time.

According to an embodiment, when the gate voltage is provided to the first pixel line and the n+1th pixel line, the processor 130 may sequentially provide a data voltage to a pixel included in the first pixel line, using the first data driver 133-1 and may sequentially provide a data voltage to a pixel included in the n+1th pixel line, using the second data driver 133-2. In this case, two pixels may sequentially emit at the same time.

As described above, the electronic device 600 may provide the gate voltage to the first group of gate lines 140 and the second group of gate lines 150 at the same time. As such, the electronic device 600 may reduce the time from a point in time when image data is output at one end of the display panel 110 to a point in time when image data is output at the other end of the display panel 110 and may reduce the distortion of content displayed on the display so as to be in a specified level or less.

Figure 6B:
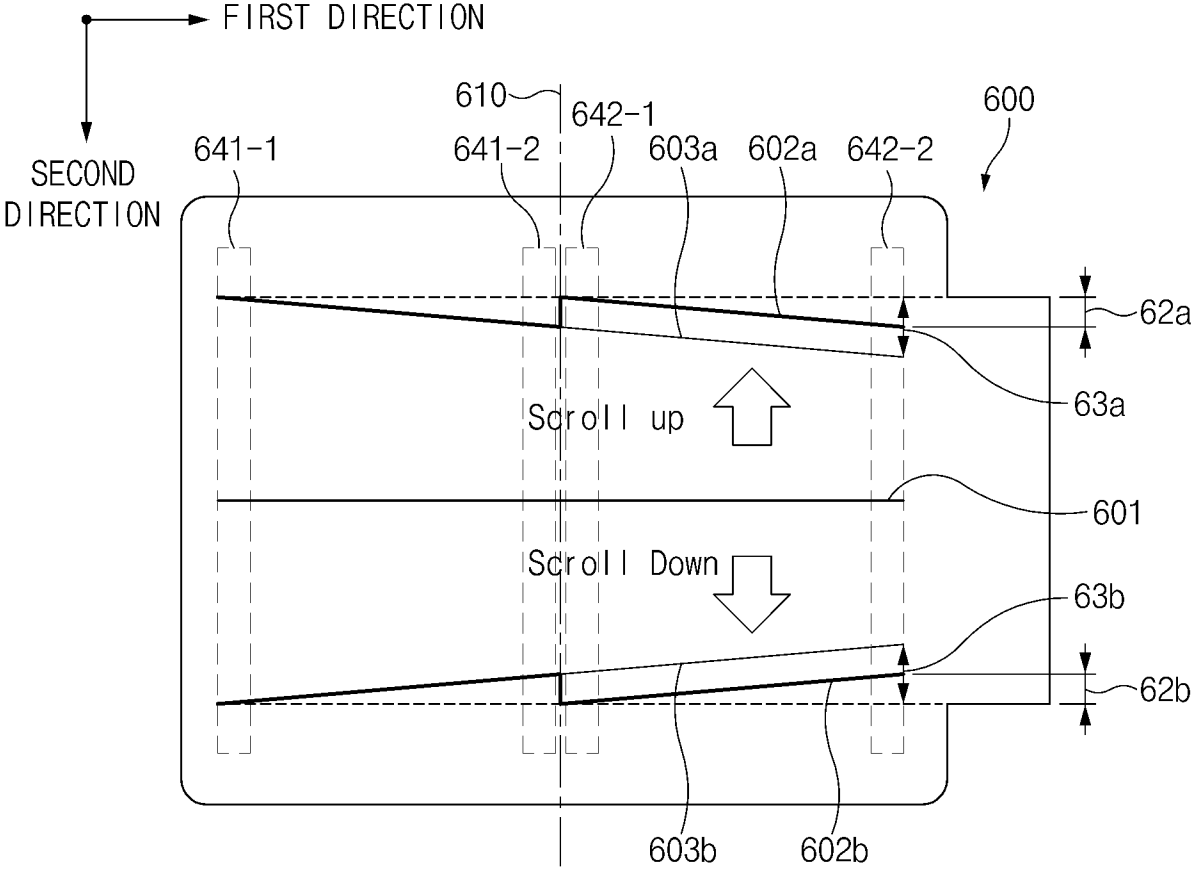
FIG. 6B is a diagram illustrating an example extent to which content is distorted due to a scroll operation in an electronic device, according to various embodiments.

FIG. 6B is a diagram illustrating an example extent to which a screen is dragged due to a scroll operation in an example electronic device, according to various embodiments.

Referring to FIG. 6B, a first line 601 may represent at least one content, for example, and without limitation, a text or an image, which is displayed on a display before the user scrolls. A second line **602*a* and a fourth line 602*b* may illustrate that at least one content is output in the electronic device 600 illustrated in FIG. 6A while the user scrolls. A third line 603***a* and a fifth line 603*b* may illustrate that at least one content is output in an electronic device different from the electronic device 600 illustrated in FIG. 6A while the user scrolls. For example, the third line 603*a* and the fifth line 603*b* may be the same as or similar to the third line 403*a* and the fourth line 403*b* illustrated in FIG. 4B.

In the description of FIG. 6B, the electronic device 600 is referred to as a first electronic device 600, and the other electronic device may be referred to as an electronic device.

According to an embodiment, the first electronic device 600 may sequentially provide a gate voltage to the pixel line from a first output area 641-1 to a second output area 641-2 and may sequentially provide a gate voltage to the pixel line from a third output area 642-1 to a fourth output area 642-2.

According to an embodiment, the difference in time from a point in time when the first electronic device 600 outputs the specified image data to the first output area 641-1 to a point in time when the first electronic device 600 outputs the specified image data to the second output area 641-2 may be the time T1. Moreover, the difference in time from a point in time when the first electronic device 600 outputs the specified image data to the third output area 642-1 to a point in time when the first electronic device 600 outputs the specified image data to the fourth output area 642-2 may also be the time T1. For example, the time required for the first electronic device 600 to output the specified image data from the first output area 641-1 to the fourth output area 642-2 may also be the time T1.

According to an embodiment, the electronic device may sequentially provide a gate voltage from the first output area 641-1 to the fourth output area 642-2 in the first direction. In this case, the difference in time from a point in time when the electronic device outputs the specified image data to the first output area 641-1 to a point in time when the electronic device outputs the specified image data to the fourth output area 642-2 may be a time T2. According to an embodiment, the time T2 may be approximately twice the time T1.

According to various embodiments, when the user scrolls in a direction opposite to the second direction, the phenomenon that the screen is dragged may occur in the first electronic device 600 and the electronic device. For example, referring to the third line 603*a*, before the T2 time elapses after the electronic device outputs new image data to the first output area 641-1 in response to the scroll operation of the user, the electronic device may output the existing image data to the fourth output area 642-2. Accordingly, as illustrated in FIG. 6B, in the third line 603*a*, the difference in height between the first output area 641-1 and the fourth output area 642-2 may be as high as a second height 63*a*.

For another example, referring to the second line 602*a*, before the T1 time elapses after the first electronic device 600 outputs new image data to the first output area 641-1 and third output area 642-1 in response to the scroll operation of the user, the first electronic device 600 may output the existing image data to the second output area 641-2 and the fourth output area 642-2. Accordingly, as illustrated in FIG. 6B, in the second line 602*a*, the difference in height between the first output area 641-1 and the fourth output area 642-2 may be as high as a first height 62*a*. Because the first height 62*a* is about half the second height 63*a*, the first electronic device 600 may reduce the phenomenon that the screen is dragged, compared to the electronic device.

According to various embodiments, when the user scrolls in the second direction, the phenomenon that the screen is dragged may occur in the first electronic device 600 and the electronic device. Referring to the fourth line 602*b* and the fifth line 603*b*, the extent to which the screen is dragged in the first electronic device 600 may be as height as a third height 62*b*, and the extent to which the screen is dragged in the electronic device may be as height as a fourth height 63*b*. Because the third height 62*b* is about half the fourth height 63*b*, the first electronic device 600 may reduce the phenomenon that the screen is dragged, to a specified level or less compared to the electronic device.

Figure 6C:
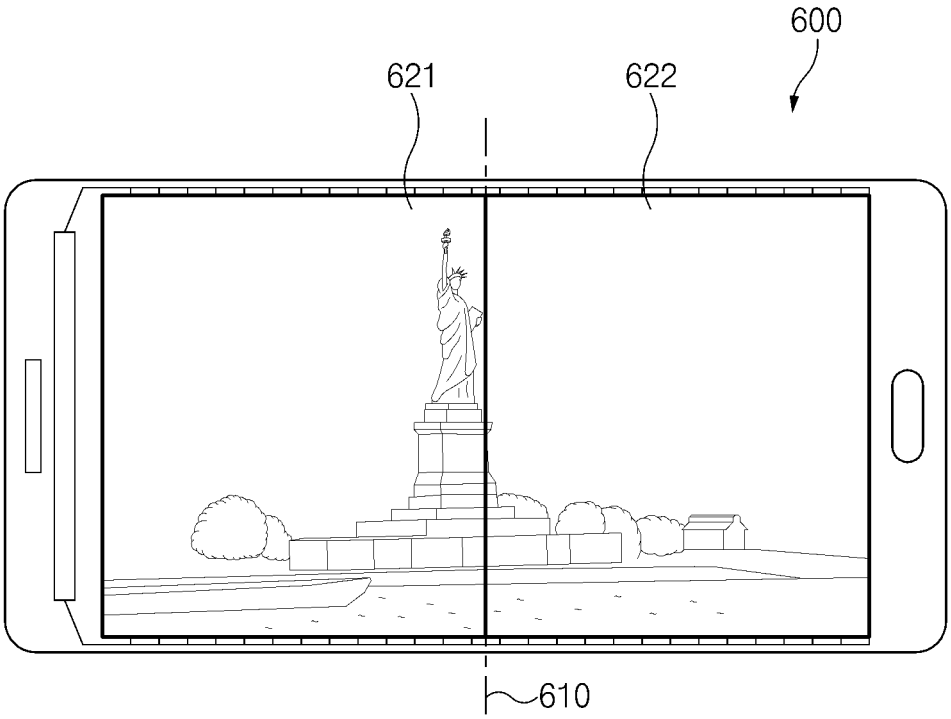
FIG. 6C is a diagram illustrating an example procedure in which an electronic device outputs a specified image, according to another embodiment.

FIG. 6C is a diagram illustrating an example procedure in which an example electronic device outputs a specified image, according to another embodiment.

Referring to FIG. 6C, the electronic device 600 may divide one frame of specified image data into two areas to output the divided result. For example, the electronic device 600 may output a part of the specified image data in the first area 621 and may output the remaining parts of the specified image data in the second area 622.

According to an embodiment, the electronic device 600 may provide a gate voltage to a pixel line included in the first area 621 through a first group of gate lines during a first time to output a part of specified image data. According to an embodiment, the electronic device 600 may provide a gate voltage to a pixel line included in the second area 622 through a second group of gate lines during the first time to output the remaining parts of the specified image data.

According to an embodiment, the first time may be approximately half of the second time required for the electronic device 600 to sequentially provide a gate voltage to all the pixel lines from the first pixel line to the 2n-th pixel line and to output the specified image data. The electronic device 600 may reduce the phenomenon that the screen is dragged, to a specified level or less, by outputting specified image data during a time less than a specified time.

Figure 7A:
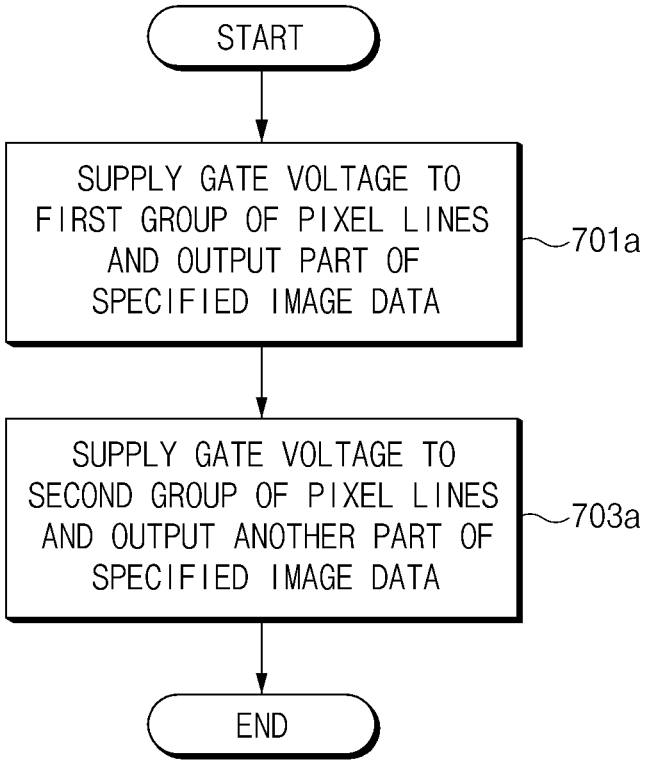
FIG. 7A is a flowchart illustrating an example procedure in which an electronic device outputs a specified image, according to an embodiment.

FIG. 7A is a flowchart illustrating an example procedure in which an electronic device outputs a specified image, according to an embodiment.

Referring to FIG. 7A, the method in which an electronic device outputs a specified image may include, for example, and without limitation, operation 701*a* and operation 703*a*. It is understood that operation 701*a* and operation 703*a* are performed by an electronic device (e.g., the electronic device 100 of FIG. 3) or a processor (e.g., the processor 130 of FIG. 3).

In operation 701*a*, the electronic device may provide (e.g., supply) a gate voltage to a first group of pixel lines through a first group of gate lines. For example, as illustrated in FIG. 4A, the first group of pixel lines may include odd-numbered pixel lines. The electronic device may display (e.g., output at least part of specified image data from one end of a display to the other end thereof through operation 701*a*.

In operation 703*a*, the electronic device may provide (e.g., supply) a gate voltage to a second group of pixel lines through a second group of gate lines. For example, as illustrated in FIG. 4A, the second group of pixel lines may include even-numbered pixel lines. The electronic device may display (e.g., output) the remaining parts of the specified image data from one end of the display to the other end thereof through operation 703*a*.

The difference in time between a point in time when new image data is output to one end of the display and a point in time when new image data is output to the other end of the display, through operation 701*a* and operation 703*a* may be reduced as compared with the specified time. As such, the electronic device may reduce the phenomenon that the screen is dragged, to a specified level or less.

Figure 7B:
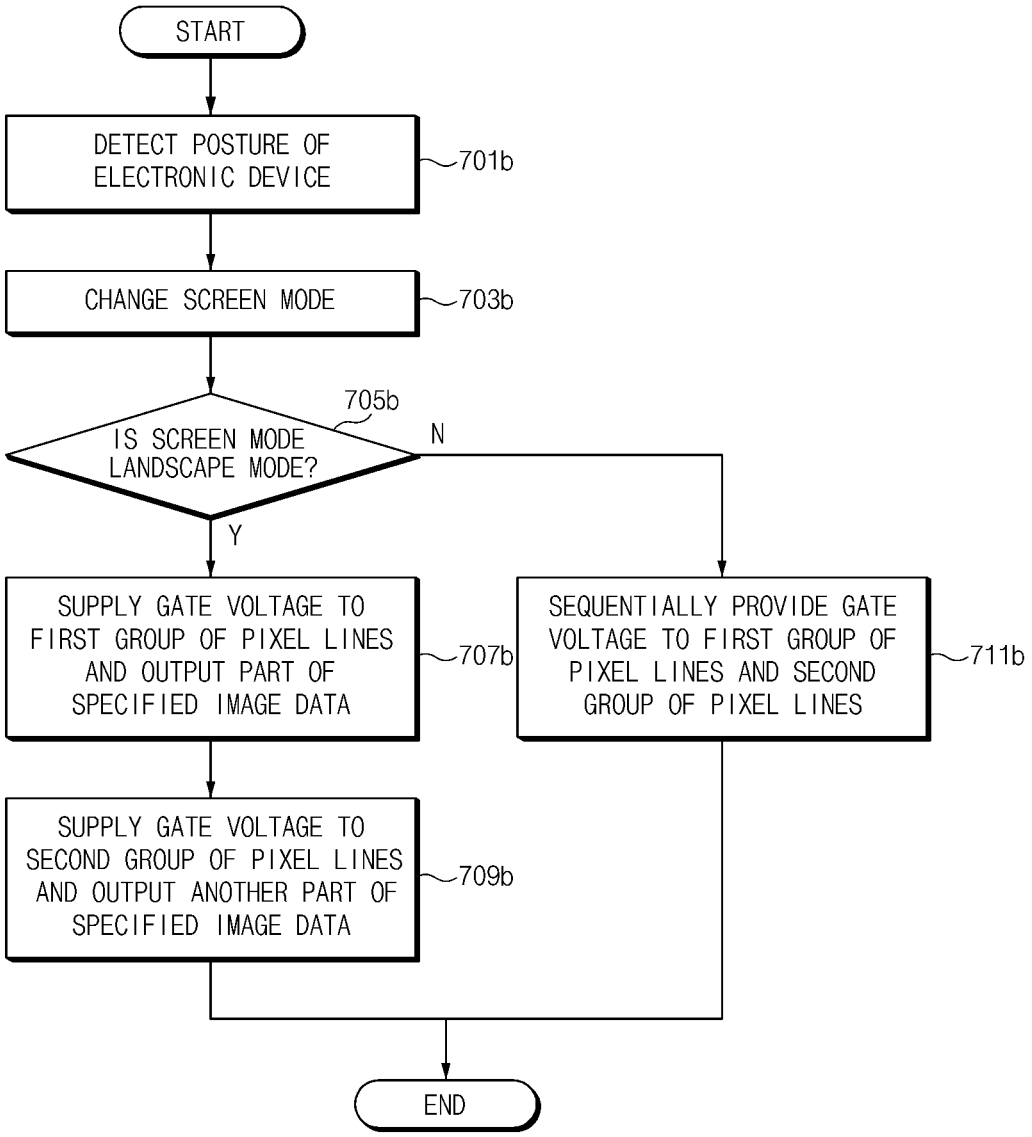
FIG. 7B is a flowchart illustrating an example procedure in which an electronic device outputs a specified image based on a screen mode, according to an embodiment.

FIG. 7B is a flowchart illustrating an example procedure in which an electronic device outputs a specified image based on a screen mode, according to an embodiment.

Referring to FIG. 7B, a method in which an electronic device outputs a specified image based on a screen mode may include, for example, and without limitation, operations 701*b*, 703*b*, 705*b*, 707*b*, 709*b* and 711*b*. It is understood that operation 701*b*, 703*b*, 705*b*, 707*b*, 709*b* and 711*b* are performed by an electronic device (e.g., the electronic device 100 of FIG. 3) or a processor (e.g., the processor 130 of FIG. 3). According to various embodiments, at least one operation of operation 701*b*, 703*b*, 705*b*, 707*b*, 709*b* and 711*b* may be skipped, and another operation may be added in addition to operation 701*b*, 703*b*, 705*b*, 707*b*, 709*b* and 711*b*. For example, the electronic device may skip operation 701*b* and may perform operation 703*b* based on the control of a user. In the descriptions of FIG. 7B, the description duplicated with reference to FIG. 7A may partially not be repeated. For example, operation 707*b* or operation 709*b* may be briefly described because operation 707*b* or operation 709*b* overlaps with the description of operation 701*a* or operation 703*a* illustrated in FIG. 7A, respectively.

In operation 701*b*, the electronic device may detect the posture (e.g., orientation) of the electronic device. For example, the electronic device may include at least one sensor that senses the posture of the electronic device and may determine which any surface of the electronic device is parallel to the ground surface, using the at least one sensor. The at least one sensor may include, for example, at least one of a gyro sensor, an acceleration sensor, or a geomagnetic sensor.

According to an embodiment, the display panel of the electronic device may include a first edge extending in a first direction and a second edge extending from one end of the first edge in a second direction perpendicular to the first direction. The electronic device may determine whether one edge of the first edge and the second edge is substantially parallel to the ground surface, using the at least one sensor.

In operation 703*b*, the electronic device may change the screen mode based on the determined posture of the electronic device. For example, when the first edge is substantially parallel to the ground surface, the electronic device may change the screen mode to a landscape mode. For another example, when the second edge is substantially parallel to the ground surface, the electronic device may change the screen mode to a portrait mode.

In operation 705*b*, the electronic device may determine whether the screen mode is a landscape mode. When the screen mode is the landscape mode (Y of operation 705*b*), the electronic device may perform operation 707*b*; when the screen mode is the portrait mode (N of operation 705*b*), the electronic device may perform operation 711*b*.

In operation 707*b*, the electronic device may supply a gate voltage to a first group of pixel lines through a first group of gate lines and output part of the specified image data. Operation 707*b* may be the same as or similar to operation 701*a* of FIG. 7A.

In operation 709*b*, the electronic device may supply a gate voltage to a second group of pixel lines through a second group of gate lines and output another part of the specified image data. Operation 709*b* may be the same as or similar to operation 703*a* of FIG. 7A.

In operation 711*b*, because the screen mode is the portrait mode, the electronic device may sequentially provide (e.g., supply) a gate voltage without distinction between the first group of pixel lines and the second group of pixel lines. When the screen mode is the portrait mode, the scroll direction of a user may be a direction perpendicular to the gate line direction of the electronic device. In this case, because the phenomenon that the screen is dragged in response to the user's scroll does not occur, the electronic device may sequentially provide a gate voltage from the first pixel line the 2n-th pixel line. In this case, the processor may control the first gate driver and the second gate driver to alternately provide a gate voltage to the first group of gate lines and the second group of gate lines.

The electronic device may effectively output a specified image based on a screen mode, through operation 701*b*, 703*b*, 705*b*, 707*b*, 709*b* and 711*b*. For example, when the screen mode is the landscape mode, after providing a gate voltage the first group of pixel lines, the electronic device may provide a gate voltage to the second group of pixel lines to reduce the phenomenon that the screen is dragged. For another example, when the screen mode is the portrait mode, the electronic device may sequentially provide a gate voltage to the pixel lines included in the first group of pixel lines and the second group of pixel lines to stably drive a display.

Figure 8A:
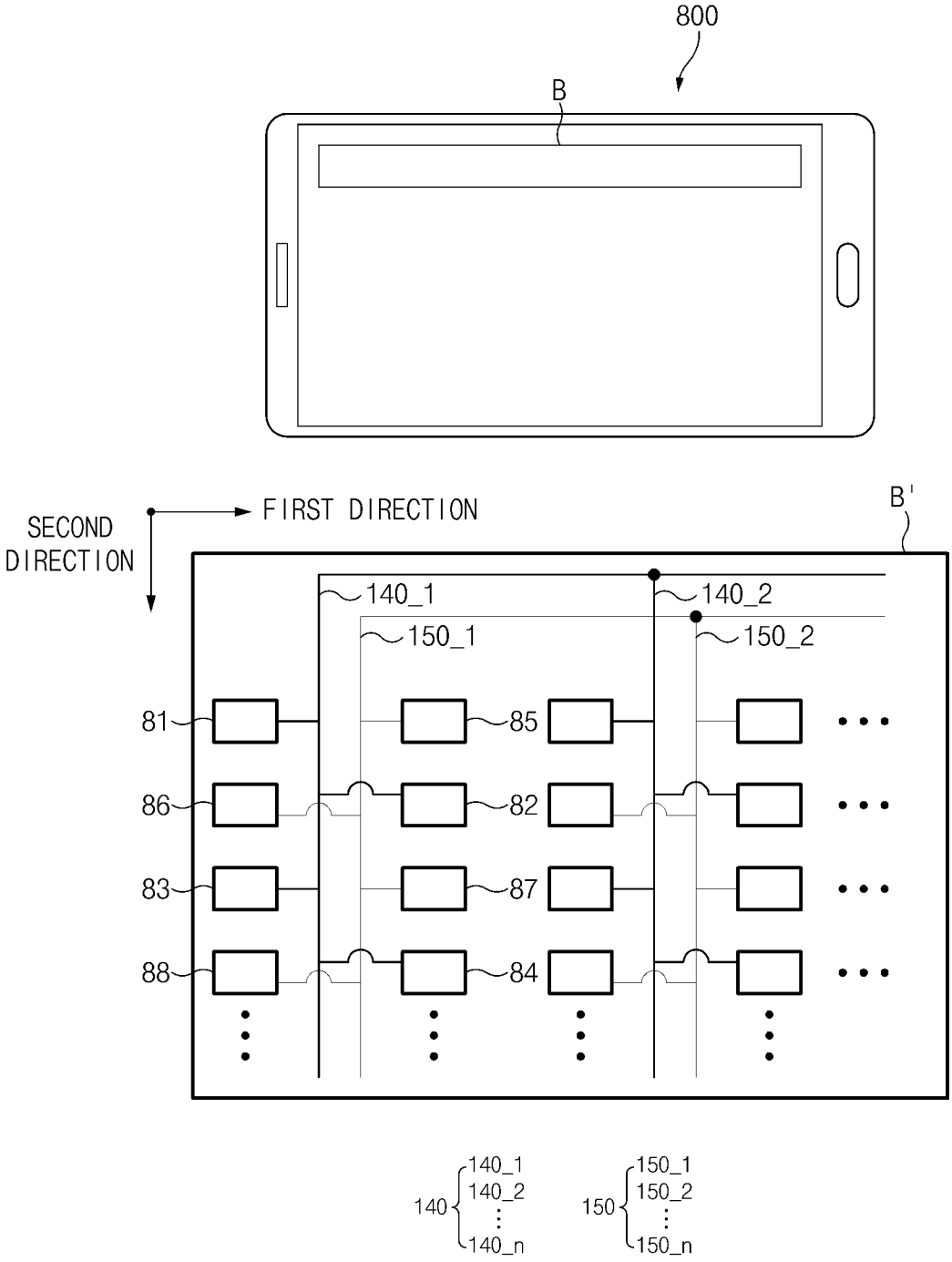
FIG. 8A is a diagram illustrating an example electronic device and an enlarged view of the example electronic device according to an embodiment.

FIG. 8A is a diagram illustrating an example electronic device and an enlarged view of the electronic device according to an embodiment.

Referring to FIG. 8A, an area B' from enlarging an area B of an electronic device 800 may represent the partial area of a display. According to an embodiment, the area B' may include a first group of pixel lines, a second group of pixel lines, the first group of gate lines 140, and the second group of gate lines 150.

According to an embodiment, the first group of gate lines 140 and the second group of gate lines 150 may be arranged alternately with each other. For example, the first group of gate lines 140 may be sequentially arranged in a first direction, and the second group of gate lines 150 may interposed between two of the first group of gate lines 140, which are different from each other. According to an embodiment, the first group of gate lines 140 may be electrically connected to the first group of pixel lines, respectively; the second group of gate lines 150 may be electrically connected to the second group of pixel lines, respectively.

According to an embodiment, the first group of pixel lines and the second group of pixel lines may be formed in a zigzag shape intersecting each other. For example, the 1-1th pixel line connected to the 1-1th gate line 140_1 may be electrically connected to a first pixel 81, a second pixel 82, a third pixel 83, and a fourth pixel 84. For another example, the 2-1th pixel line connected to the 2-1th gate line 150_1 may be electrically connected to a fifth pixel 85, a sixth pixel 86, a seventh pixel 87, and an eighth pixel 88.

Figure 8B:
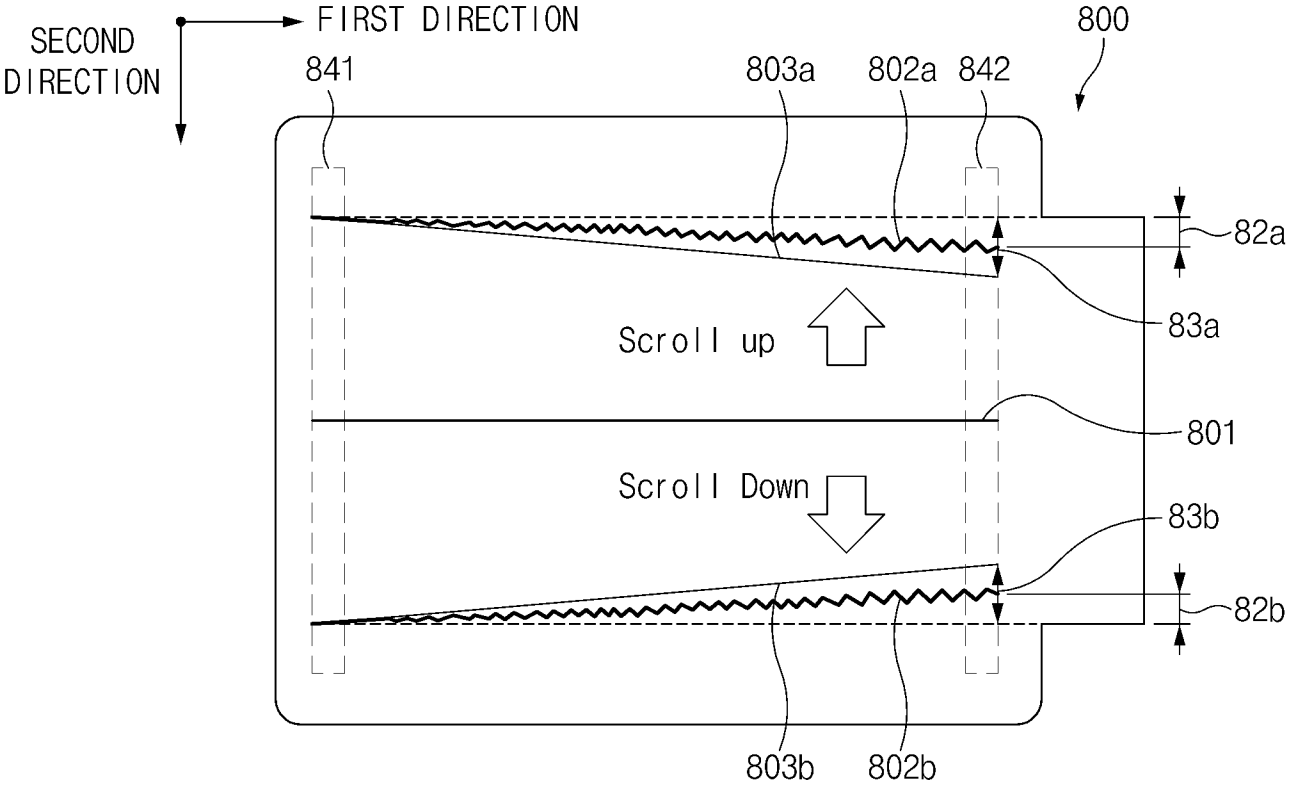
FIG. 8B is a diagram illustrating an example extent to which content is distorted due to a scroll operation in an example electronic device, according to an embodiment.

FIG. 8B is a diagram illustrating an example extent to which a screen is dragged due to a scroll operation in an example electronic device, according to an embodiment.

Referring to FIG. 8B, a first line 801 may represent at least one content, for example, and without limitation, a text or an image, which is displayed on a display before the user scrolls. A second line 802*a* and a fourth line 802*b* may illustrate that at least one content is output in the electronic device 800 illustrated in FIG. 8A while the user scrolls. A third line 803*a* and a fifth line 803*b* may illustrate that at least one content is output in an electronic device different from the electronic device 800 illustrated in FIG. 8A while the user scrolls. For example, the third line 803*a* and the fifth line 803*b* may be the same as or similar to the third line 403*a* and the fourth line 403*b* illustrated in FIG. 4B.

In the description of FIG. 8B, the electronic device 800 is referred to as a first electronic device 800, and the other electronic device may be referred to as a second electronic device. Moreover, in the descriptions of FIG. 8B, the description duplicated with reference to FIG. 4B may be omitted.

According to an embodiment, the extent to which the screen is dragged by a first height 82*a* or a third height 82*b* may occur in the first electronic device 800, and the extent to which the screen is dragged by a second height 83*a* or a fourth height 83*b* may occur in the second electronic device. The first height 82*a* and the third height 82*b* may be approximately half of the second height 83*a* and the fourth height 83*b*, respectively. Accordingly, the first electronic device 800 may reduce the phenomenon that the screen is dragged, compared to the second electronic device.

In various embodiments, referring to the second line 802*a* and the fourth line 802*b*, because the pixel line is formed in a zigzag shape in the first electronic device 800, the phenomenon that the screen is dragged, which is experienced by the user may be further reduced. For example, because the first electronic device 800 has a wider area output by one gate line than the electronic device 400 illustrated in FIG. 4A, the phenomenon that the screen is dragged, which is recognized by the user may be further reduced.

Figure 9:
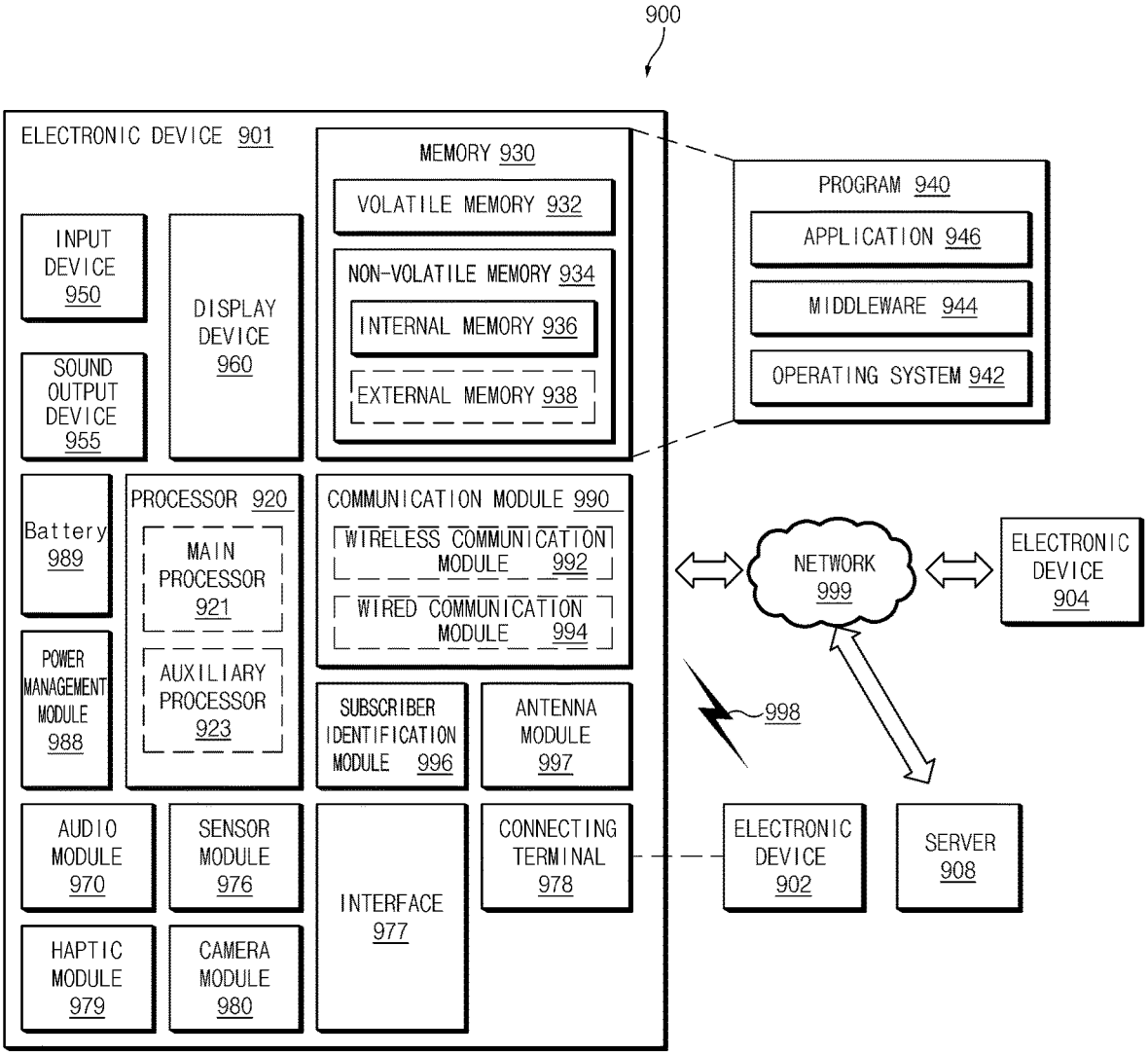
FIG. 9 is a block diagram illustrating an example electronic device in a network environment, according to various embodiments.

FIG. 9 is a block diagram illustrating an electronic device 901 in a network environment 900 according to various embodiments. Referring to FIG. 9, the electronic device 901 in the network environment 900 may communicate with an electronic device 902 via a first network 998 (e.g., a short-range wireless communication network), or an electronic device 904 or a server 908 via a second network 999 (e.g., a long-range wireless communication network). According to an embodiment, the electronic device 901 may communicate with the electronic device 904 via the server 908. According to an embodiment, the electronic device 901 may include a processor 920, memory 930, an input device 950, a sound output device 955, a display device 960, an audio module 970, a sensor module 976, an interface 977, a haptic module 979, a camera module 980, a power management module 988, a battery 989, a communication module 990, a subscriber identification module (SIM) 996, or an antenna module 997. In some embodiments, at least one (e.g., the display device 960 or the camera module 980) of the components may be omitted from the electronic device 901, or one or more other components may be added in the electronic device 901. In some embodiments, some of the components may be implemented as single integrated circuitry. For example, the sensor module 976 (e.g., a fingerprint sensor, an iris sensor, or an illuminance sensor) may be implemented as embedded in the display device 960 (e.g., a display).

The processor 920 may execute, for example, software (e.g., a program 940) to control at least one other component (e.g., a hardware or software component) of the electronic device 901 coupled with the processor 920, and may perform various data processing or computation. According to one embodiment, as at least part of the data processing or computation, the processor 920 may load a command or data received from another component (e.g., the sensor module 976 or the communication module 990) in volatile memory 932, process the command or the data stored in the volatile memory 932, and store resulting data in non-volatile memory 934. According to an embodiment, the processor 920 may include a main processor 921 (e.g., a central processing unit (CPU) or an application processor (AP)), and an auxiliary processor 923 (e.g., a graphics processing unit (GPU), an image signal processor (ISP), a sensor hub processor, or a communication processor (CP)) that is operable independently from, or in conjunction with, the main processor 921. Additionally or alternatively, the auxiliary processor 923 may be adapted to consume less power than the main processor 921, or to be specific to a specified function. The auxiliary processor 923 may be implemented as separate from, or as part of the main processor 921.

The auxiliary processor 923 may control at least some of functions or states related to at least one component (e.g., the display device 960, the sensor module 976, or the communication module 990) among the components of the electronic device 901, instead of the main processor 921 while the main processor 921 is in an inactive (e.g., sleep) state, or together with the main processor 921 while the main processor 921 is in an active state (e.g., executing an application). According to an embodiment, the auxiliary processor 923 (e.g., an image signal processor or a communication processor) may be implemented as part of another component (e.g., the camera module 980 or the communication module 990) functionally related to the auxiliary processor 923.

The memory 930 may store various data used by at least one component (e.g., the processor 920 or the sensor module 976) of the electronic device 901. The various data may include, for example, software (e.g., the program 940) and input data or output data for a command related thereto. The memory 930 may include the volatile memory 932 or the non-volatile memory 934.

The program 940 may be stored in the memory 930 as software, and may include, for example, an operating system (OS) 942, middleware 944, or an application 946.

The input device 950 may receive a command or data to be used by other component (e.g., the processor 920) of the electronic device 901, from the outside (e.g., a user) of the electronic device 901. The input device 950 may include, for example, a microphone, a mouse, or a keyboard.

The sound output device 955 may output sound signals to the outside of the electronic device 901. The sound output device 955 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 960 may visually provide information to the outside (e.g., a user) of the electronic device 901. The display device 960 may include, for example, a display, a hologram device, or a projector and control circuitry to control a corresponding one of the display, hologram device, and projector. According to an embodiment, the display device 960 may include touch circuitry adapted to detect a touch, or sensor circuitry (e.g., a pressure sensor) adapted to measure the intensity of force incurred by the touch.

The audio module 970 may convert a sound into an electrical signal and vice versa. According to an embodiment, the audio module 970 may obtain the sound via the input device 950, or output the sound via the sound output device 955 or a headphone of an external electronic device (e.g., an electronic device 902) directly (e.g., wiredly) or wirelessly coupled with the electronic device 901.

The sensor module 976 may detect an operational state (e.g., power or temperature) of the electronic device 901 or an environmental state (e.g., a state of a user) external to the electronic device 901, and then generate an electrical signal or data value corresponding to the detected state. According to an embodiment, the sensor module 976 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 977 may support one or more specified protocols to be used for the electronic device 901 to be coupled with the external electronic device (e.g., the electronic device 902) directly (e.g., wiredly) or wirelessly. According to an embodiment, the interface 977 may include, for example, a high definition multimedia interface (HDMI), a universal serial bus (USB) interface, a secure digital (SD) card interface, or an audio interface.

A connecting terminal 978 may include a connector via which the electronic device 901 may be physically connected with the external electronic device (e.g., the electronic device 902). According to an embodiment, the connecting terminal 978 may include, for example, a HDMI connector, a USB connector, a SD card connector, or an audio connector (e.g., a headphone connector).

The haptic module 979 may convert an electrical signal into a mechanical stimulus (e.g., a vibration or a movement) or electrical stimulus which may be recognized by a user via his tactile sensation or kinesthetic sensation. According to an embodiment, the haptic module 979 may include, for example, a motor, a piezoelectric element, or an electric stimulator.

The camera module 980 may capture a still image or moving images. According to an embodiment, the camera module 980 may include one or more lenses, image sensors, image signal processors, or flashes.

The power management module 988 may manage power supplied to the electronic device 901. According to one embodiment, the power management module 988 may be implemented as at least part of, for example, a power management integrated circuit (PMIC).

The battery 989 may supply power to at least one component of the electronic device 901. According to an embodiment, the battery 989 may include, for example, a primary cell which is not rechargeable, a secondary cell which is rechargeable, or a fuel cell.

The communication module 990 may support establishing a direct (e.g., wired) communication channel or a wireless communication channel between the electronic device 901 and the external electronic device (e.g., the electronic device 902, the electronic device 904, or the server 908) and performing communication via the established communication channel. The communication module 990 may include one or more communication processors that are operable independently from the processor 920 (e.g., the application processor (AP)) and supports a direct (e.g., wired) communication or a wireless communication. According to an embodiment, the communication module 990 may include a wireless communication module 992 (e.g., a cellular communication module, a short-range wireless communication module, or a global navigation satellite system (GNSS) communication module) or a wired communication module 994 (e.g., a local area network (LAN) communication module or a power line communication (PLC) module). A corresponding one of these communication modules may communicate with the external electronic device via the first network 998 (e.g., a short-range communication network, such as Bluetooth™ wireless-fidelity (Wi-Fi) direct, or infrared data association (IrDA)) or the second network 999 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 992 may identify and authenticate the electronic device 901 in a communication network, such as the first network 998 or the second network 999, using subscriber information (e.g., international mobile subscriber identity (IMSI)) stored in the subscriber identification module 996.

The antenna module 997 may transmit or receive a signal or power to or from the outside (e.g., the external electronic device) of the electronic device 901. According to an embodiment, the antenna module 997 may include one or more antennas, and, therefrom, at least one antenna appropriate for a communication scheme used in the communication network, such as the first network 998 or the second network 999, may be selected, for example, by the communication module 990 (e.g., the wireless communication module 992). The signal or the power may then be transmitted or received between the communication module 990 and the external electronic device via the selected at least one antenna.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 901 and the external electronic device 904 via the server 908 coupled with the second network 999. Each of the electronic devices 902 and 904 may be a device of a same type as, or a different type, from the electronic device 901. According to an embodiment, all or some of operations to be executed at the electronic device 901 may be executed at one or more of the external electronic devices 902, 904, or 908. For example, if the electronic device 901 should perform a function or a service automatically, or in response to a request from a user or another device, the electronic device 901, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 901. The electronic device 901 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," "A and/or B" and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 940) including one or more instructions that are stored in a storage medium (e.g., internal memory 936 or external memory 938) that is readable by a machine (e.g., the electronic device 901). For example, a processor (e.g., the processor 920) of the machine (e.g., the electronic device 901) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 10:
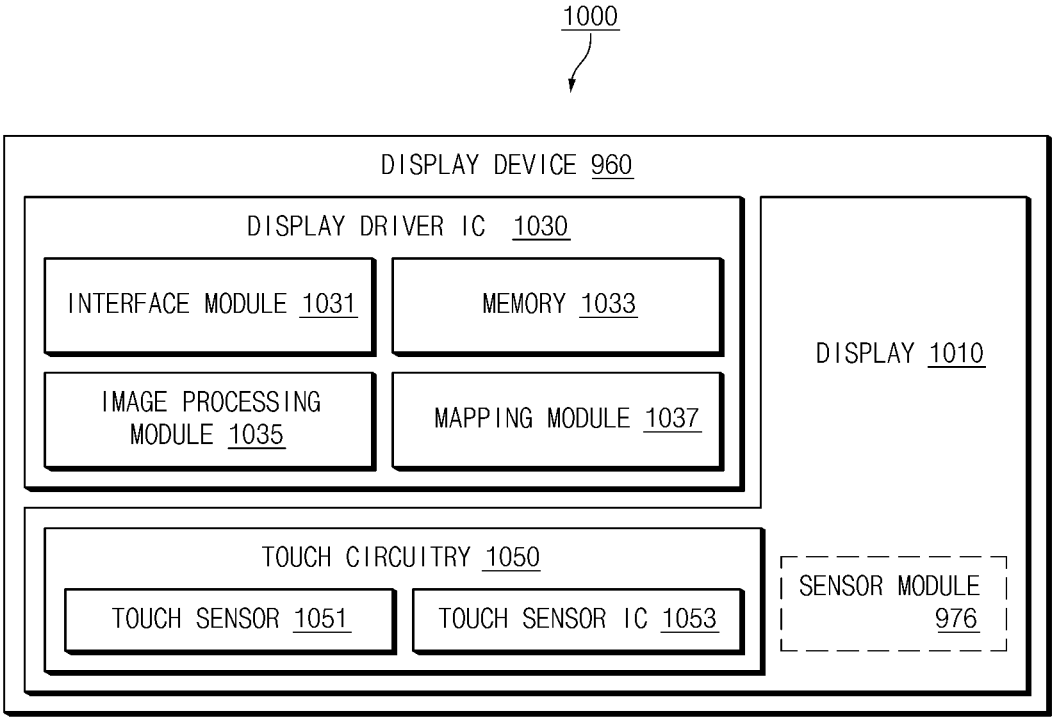
FIG. 10 is a block diagram illustrating an example display device, according to various embodiments.

FIG. 10 is a block diagram 1000 illustrating the display device 960 according to various embodiments. Referring to FIG. 10, the display device 960 may include a display 1010 and a display driver integrated circuit (DDI) 1030 to control the display 1010. The DDI 1030 may include an interface module 1031, memory 1033 (e.g., buffer memory), an image processing module 1035, or a mapping module 1037. The DDI 1030 may receive image information that contains image data or an image control signal corresponding to a command to control the image data from another component of the electronic device 901 via the interface module 1031. For example, according to an embodiment, the image information may be received from the processor 920 (e.g., the main processor 921 (e.g., an application processor)) or the auxiliary processor 923 (e.g., a graphics processing unit) operated independently from the function of the main processor 921. The DDI 1030 may communicate, for example, with touch circuitry 950 or the sensor module 976 via the interface module 1031. The DDI 1030 may also store at least part of the received image information in the memory 1033, for example, on a frame by frame basis.

The image processing module 1035 may perform pre-processing or post-processing (e.g., adjustment of resolution, brightness, or size) with respect to at least part of the image data. According to an embodiment, the pre-processing or post-processing may be performed, for example, based at least in part on one or more characteristics of the image data or one or more characteristics of the display 1010.

The mapping module 1037 may generate a voltage value or a current value corresponding to the image data pre-processed or post-processed by the image processing module 1035. According to an embodiment, the generating of the voltage value or current value may be performed, for example, based at least in part on one or more attributes of the pixels (e.g., an array, such as an RGB stripe or a pentile structure, of the pixels, or the size of each subpixel). At least some pixels of the display 1010 may be driven, for example, based at least in part on the voltage value or the current value such that visual information (e.g., a text, an image, or an icon) corresponding to the image data may be displayed via the display 1010.

According to an embodiment, the display device 960 may further include the touch circuitry 1050. The touch circuitry 1050 may include a touch sensor 1051 and a touch sensor IC 1053 to control the touch sensor 1051. The touch sensor IC 1053 may control the touch sensor 1051 to sense a touch input or a hovering input with respect to a certain position on the display 1010. To achieve this, for example, the touch sensor 1051 may detect (e.g., measure) a change in a signal (e.g., a voltage, a quantity of light, a resistance, or a quantity of one or more electric charges) corresponding to the certain position on the display 1010. The touch circuitry 1050 may provide input information (e.g., a position, an area, a pressure, or a time) indicative of the touch input or the hovering input detected via the touch sensor 1051 to the processor 920. According to an embodiment, at least part (e.g., the touch sensor IC 1053) of the touch circuitry 1050 may be formed as part of the display 1010 or the DDI 1030, or as part of another component (e.g., the auxiliary processor 923) disposed outside the display device 960.

According to an embodiment, the display device 960 may further include at least one sensor (e.g., a fingerprint sensor, an iris sensor, a pressure sensor, or an illuminance sensor) of the sensor module 976 or a control circuit for the at least one sensor. In such a case, the at least one sensor or the control circuit for the at least one sensor may be embedded in one portion of a component (e.g., the display 1010, the DDI 1030, or the touch circuitry 950)) of the display device 960. For example, when the sensor module 976 embedded in the display device 960 includes a biometric sensor (e.g., a fingerprint sensor), the biometric sensor may obtain biometric information (e.g., a fingerprint image) corresponding to a touch input received via a portion of the display 1010. As another example, when the sensor module 976 embedded in the display device 960 includes a pressure sensor, the pressure sensor may obtain pressure information corresponding to a touch input received via a partial or whole area of the display 1010. According to an embodiment, the touch sensor 1051 or the sensor module 976 may be disposed between pixels in a pixel layer of the display 1010, or over or under the pixel layer.

According to an embodiment of the disclosure, an electronic device may include a display panel including a first edge extending in a first direction and a second edge extending from one end of the first edge in a second direction perpendicular to the first direction, a first group of gate lines supplying a first gate voltage to the first pixel line and supplying a third gate voltage to the third pixel line, a second group of gate lines supplying a second gate voltage to the second pixel line and supplying a fourth gate voltage to the fourth pixel line, and at least one processor electrically connected to each of the first group of gate lines and the second group of gate lines. The display panel may include a first pixel line, a second pixel line arranged at a next line of the first pixel line, a third pixel line arranged at a next line of the second pixel line, and a fourth pixel line arranged at a next line of the third pixel line. The at least one processor may be configured to sequentially supply the first gate voltage and the third gate voltage to the first pixel line and the third pixel line through the first group of gate lines to output a part of specified image data and to sequentially supply the second gate voltage and the fourth gate voltage to the second pixel line and the fourth pixel line through the second group of gate lines to output another part different from the part of the specified image data.

According to an embodiment, the first group of gate lines may be arranged on the display panel from the second edge in the first direction at an odd-numbered location, and the second group of gate lines may be arranged on the display panel from the second edge in the first direction at an even-numbered location.

According to an embodiment, the at least one processor may be configured to sequentially supply the first gate voltage and the third gate voltage through the first group of gate lines at a first specified time to output the part of the specified image data through the display panel, and to sequentially supply the second gate voltage and the fourth gate voltage through the second group of gate lines at a second specified time synchronized with the first specified time to output the other part of the specified image data through the display panel.

In an embodiment, the second specified time is synchronized at the same time as the first specified time.

According to an embodiment, the electronic device may further include a first group of data lines sequentially arranged in the second direction and configured to transmit a data voltage to the first pixel line and the third pixel line and a second group of data lines sequentially arranged in the second direction and configured to transmit the data voltage to the second pixel line and the fourth pixel line. The at least one processor may be configured, while the first gate voltage or the third gate voltage is transmitted through the first group of gate lines, to provide the data voltage to the first group of data lines to output the part of the specified image data and while the second gate voltage or the fourth gate voltage is transmitted through the second group of gate lines, to provide the data voltage to the second group of data lines to output the other part of the specified image data.

According to an embodiment, the at least one processor may be configured when a screen mode of the electronic device is a landscape mode, after sequentially supplying the first gate voltage and the third gate voltage to output the part, to sequentially supply the second gate voltage and the fourth gate voltage to output the other part.

In an embodiment, the at least one processor may be configured when the screen mode of the electronic device is a portrait mode, to sequentially supply the first gate voltage, the second gate voltage, the third gate voltage, and the fourth gate voltage to output the part and the other part.

In an embodiment, the electronic device may further include at least one sensor sensing a posture of the electronic device. The at least one processor may be configured, when the first edge is substantially parallel to a ground surface by using the at least one sensor, to change the screen mode of the electronic device to a portrait mode and when the second edge is substantially parallel to the ground surface by using the at least one sensor, to change the screen mode of the electronic device to a landscape mode.

According to an embodiment, the first pixel line and the second pixel line may intersect each other in a zigzag shape, and the third pixel line and the fourth pixel line may intersect each other in the zigzag shape.

According to an embodiment of the disclosure, an electronic device may include a display panel including a first area including a first group of pixel lines and a second area including a second group of pixel lines, a first group of gate lines supplying a gate voltage to the first group of pixel lines, respectively, a second group of gate lines supplying the gate voltage to the second group of pixel lines, respectively, at least one processor electrically connected to each of the first group of gate lines and the second group of gate lines. The at least one processor may be configured to supply the gate voltage to the first group of pixel lines through the first group of gate lines at a first specified time to output at least part of specified image data and to supply the gate voltage to the second group of pixel lines through the second group of gate lines at a second specified time synchronized with the first specified time to output the remaining parts of the specified image data.

According to an embodiment, the display panel may include a first edge extending in a first direction, a second edge extending from one end of the first edge in a second direction perpendicular to the first direction, and a third edge extending from the other end of the first edge in the second direction. The first group of gate lines may be sequentially arranged from the second edge to a specified point between the second edge and the third edge and the second group of gate lines may be sequentially arranged from the specified point to the third edge.

According to an embodiment, the second specified time is synchronized at the same time as the first specified time.

According to an embodiment, the electronic device may further include a first group of data lines transmitting a data voltage to the first group of pixel lines and a second group of data lines transmitting the data voltage to the second group of pixel lines. The at least one processor may be configured, while the gate voltage is supplied to the first group of pixel lines by the first group of gate lines, to provide the data voltage to the first group of data lines to output the at least part of the specified image data and while the gate voltage is supplied to the second group of pixel lines by the second group of gate lines, to provide the data voltage to the second group of data lines to output the remaining parts of the specified image data.

In an embodiment, the display panel may include a first edge extending in a first direction, a second edge extending from one end of the first edge in a second direction perpendicular to the first direction, and a third edge extending from the other end of the first edge in the second direction, and the first group of data lines and the second group of data lines are sequentially arranged in the second direction.

According to an embodiment, a first pixel line among the first group of pixel lines and a second pixel line adjacent to the first pixel line may intersect each other in a zigzag shape, and a third pixel line among the second group of pixel lines and a fourth pixel line adjacent to the third pixel line may intersect each other in a zigzag shape.

According to another embodiment of the disclosure, an electronic device may include a display panel including one or more first group pixel lines and one or more second group pixel lines, one or more first wires electrically connected to the one or more first group pixel lines, one or more second wires electrically connected to the one or more second group pixel lines, and a display driver integrated circuit including one or more first terminals electrically connected to the one or more first wires and one or more second terminals electrically connected to the one or more second wires, the display driver integrated circuit may be configured to sequentially drive the one or more first group pixel lines through the one or more first terminals and to sequentially drive the one or more second group pixel lines through the one or more second terminals.

According to an embodiment, the respective one or more first group pixel lines and the respective one or more second group pixel lines may be arranged alternately with each other.

According to an embodiment, the display panel may include a first area in which the one or more first group pixel lines are arranged and a second area in which the one or more second group pixel lines are arranged, and the display driver integrated circuit may be configured to provide a gate voltage to the one or more first group pixel lines at a first timing and to provide a gate voltage to the one or more second group pixel lines at a second timing synchronized with the first timing.

In an embodiment, the first timing and the second timing may be substantially the same as each other.

According to an embodiment, the display driver integrated circuit may be configured to provide the gate voltage to the second group pixel lines to output the specified image data after providing a gate voltage to the first group pixel lines when a screen mode of the electronic device is a landscape mode and to provide the gate voltage in order in which the first group pixel lines and the second group pixel lines are arranged, to output the specified image data when the screen mode is a portrait mode.

According to various embodiments of the disclosure, an electronic device may reduce content distortion due to a scroll operation. As such, when performing a scroll operation, a user may accurately recognize the content and improve the ease of use.

The electronic device according to various embodiments disclosed in the disclosure may be various types of devices. The electronic device may include, for example, and without limitation, a portable communication device (e.g., a smartphone), a computer device, a portable multimedia device, a portable medical appliance, a camera, a wearable device, or a home appliance. The electronic device according to an embodiment of the disclosure should not be limited to the above-mentioned devices.

According to various embodiments of the disclosure, an electronic device may reduce content distortion due to a scroll operation. As such, when performing a scroll operation, the user may accurately recognize the content and the ease of use may be improved. Besides, a variety of effects directly or indirectly understood through this disclosure may be provided.

While the disclosure has been illustrated and described with reference to various embodiments thereof, it will be understood by those skilled in the art that various changes in form and details may be made therein without departing from the spirit and scope of the disclosure as defined, for example, in the appended claims and their equivalents.

What is claimed is:

1. An electronic device comprising:

a display panel including a first edge extending in a first direction and a second edge extending from one end of the first edge in a second direction perpendicular to the first direction, wherein the display panel includes a first pixel line, a second pixel line arranged at a next line of the first pixel line, a third pixel line arranged at a next line of the second pixel line, and a fourth pixel line arranged at a next line of the third pixel line;

a first group of gate lines configured to supply a first gate voltage to the first pixel line and to supply a third gate voltage to the third pixel line;

a second group of gate lines configured to supply a second gate voltage to the second pixel line and to supply a fourth gate voltage to the fourth pixel line; and at least one processor configured to control the electronic device to:

(a1) sequentially supply the first gate voltage and the third gate voltage to the first pixel line and the third pixel line through the first group of gate lines to output a first part of specified image data;

(a2) sequentially supply the second gate voltage and the fourth gate voltage to the second pixel line and the fourth pixel line through the second group of gate lines to output a second part of the specified image data different from the first part of the specified image data; and (b) based on whether the electronic device is in a landscape mode or a portrait mode, selectively switch between a first driving mode in which (a1) and (a2) are performed, and a second driving mode in which gate voltage is sequentially provided to gates lines of the first and second groups of gate lines without distinction between the first group of pixel lines and the second group of pixel lines.

2. The electronic device of claim 1, wherein the first group of gate lines is arranged on the display panel from the second edge in the first direction at an odd-numbered location, and wherein the second group of gate lines is arranged on the display panel from the second edge in the first direction at an even-numbered location.

3. The electronic device of claim 1, wherein the at least one processor is configured to control the electronic device to:

sequentially supply the first gate voltage and the third gate voltage through the first group of gate lines at a first specified time to output the first part of the specified image data through the display panel, and sequentially supply the second gate voltage and the fourth gate voltage through the second group of gate lines at a second specified time synchronized with the first specified time to output the second part of the specified image data through the display panel.

4. The electronic device of claim 3, wherein the second specified time is synchronized at a same time as the first specified time.

5. The electronic device of claim 1, further comprising:

a first group of data lines sequentially arranged in the second direction and configured to transmit a data voltage to the first pixel line and the third pixel line; and a second group of data lines sequentially arranged in the second direction and configured to transmit the data voltage to the second pixel line and the fourth pixel line, wherein the at least one processor is configured to control the electronic device to:

supply the data voltage to the first group of data lines to output the first part of the specified image data while the first gate voltage or the third gate voltage is transmitted through the first group of gate lines; and supply the data voltage to the second group of data lines to output the second part of the specified image data while the second gate voltage or the fourth gate voltage is transmitted through the second group of gate lines.

6. The electronic device of claim 1, wherein the at least one processor is configured to control the electronic device to:

sequentially supply the second gate voltage and the fourth gate voltage to output the second part of the specified image data after sequentially supplying the first gate voltage and the third gate voltage to output the first part of the specified image data when the electronic device is in the landscape mode.

7. The electronic device of claim 6, wherein the at least one processor is configured to control the electronic device to:

without distinction between the first group of pixel lines and the second group of pixel lines, sequentially supply the first gate voltage, the second gate voltage, the third gate voltage, and the fourth gate voltage to output the first part of the specified image data and the second part of the specified image data when the electronic device is in the portrait mode.

8. The electronic device of claim 6, further comprising:

at least one sensor configured to sense a posture of the electronic device, wherein the at least one processor is configured to control the electronic device to:

change the screen mode of the electronic device to a landscape mode based on the first edge being substantially parallel to a ground surface based on the posture sensed by the at least one sensor; and change the screen mode of the electronic device to a portrait mode based on the second edge being substantially parallel to the ground surface based on the posture sensed by the at least one sensor.

9. The electronic device of claim 1, wherein the first pixel line and the second pixel line intersect each other in a zigzag pattern, and wherein the third pixel line and the fourth pixel line intersect each other in a zigzag pattern.

10. An electronic device comprising:

a display panel including a first area including a first group of pixel lines and a second area including a second group of pixel lines;

a first group of gate lines configured to supply a gate voltage to the first group of pixel lines;

a second group of gate lines configured to supply the gate voltage to the second group of pixel lines;

at least one processor configured to control the electronic device to:

(a1) supply the gate voltage to the first group of pixel lines through the first group of gate lines at a first specified time to output at least a first part of specified image data;

(a2) supply the gate voltage to the second group of pixel lines through the second group of gate lines at a second specified time synchronized with the first specified time to output remaining parts of the specified image data; and (b) based on whether the electronic device is in a landscape mode or a portrait mode, selectively switch between a first driving mode in which (a1) and (a2) are performed, and a second driving mode in which gate voltage is sequentially provided to gates lines of the first and second groups of gate lines without distinction between the first group of pixel lines and the second group of pixel lines.

11. The electronic device of claim 10, wherein the display panel includes a first edge extending in a first direction, a second edge extending from one end of the first edge in a second direction perpendicular to the first direction, and a third edge extending from an other end of the first edge in the second direction, wherein the first group of gate lines is sequentially arranged from the second edge to a specified point between the second edge and the third edge, and wherein the second group of gate lines is sequentially arranged from the specified point between the second edge and the third edge to the third edge.

12. The electronic device of claim 10, wherein the second specified time is synchronized at a same time as the first specified time.

13. The electronic device of claim 10, further comprising:

a first group of data lines configured to transmit a data voltage to the first group of pixel lines; and a second group of data lines configured to transmit the data voltage to the second group of pixel lines, wherein the at least one processor is configured to control the electronic device to:

supply the data voltage to the first group of data lines to output the at least the first part of the specified image data while the gate voltage is supplied to the first group of pixel lines by the first group of gate lines; and supply the data voltage to the second group of data lines to output the remaining parts of the specified image data while the gate voltage is supplied to the second group of pixel lines by the second group of gate lines.

14. The electronic device of claim 13, wherein the display panel includes a first edge extending in a first direction, a second edge extending from one end of the first edge in a second direction perpendicular to the first direction, and a third edge extending from an other end of the first edge in the second direction, and wherein the first group of data lines and the second group of data lines are sequentially arranged in the second direction.

15. The electronic device of claim 10, wherein a first pixel line among the first group of pixel lines and a second pixel line adjacent to the first pixel line intersect each other in a zigzag pattern, and wherein a third pixel line among the second group of pixel lines and a fourth pixel line adjacent to the third pixel line intersect each other in a zigzag pattern.

16. An electronic device comprising:

a display panel including one or more first group pixel lines and one or more second group pixel lines;

one or more first wires electrically connected to the one or more first group pixel lines;

one or more second wires electrically connected to the one or more second group pixel lines; and a display driver integrated circuit including one or more first terminals electrically connected to the one or more first wires and one or more second terminals electrically connected to the one or more second wires, wherein the display driver integrated circuit is configured to:

(a1) sequentially drive the one or more first group pixel lines through the one or more first terminals;

(a2) sequentially drive the one or more second group pixel lines through the one or more second terminals; and (b) based on whether the electronic device is in a landscape mode or a portrait mode, selectively switch between a first driving mode in which (a1) and (a2) are performed, and a second driving mode in which gate voltage is sequentially provided to first and second wires without distinction between the first and second wires.

17. The electronic device of claim 16, wherein respective one or more first group pixel lines and respective one or more second group pixel lines are arranged alternately with each other.

18. The electronic device of claim 16, wherein the display panel includes a first area in which the one or more first group pixel lines are arranged and a second area in which the one or more second group pixel lines are arranged, and wherein the display driver integrated circuit is configured to:

supply a gate voltage to the one or more first group pixel lines at a first timing; and supply a gate voltage to the one or more second group pixel lines at a second timing synchronized with the first timing.

19. The electronic device of claim 18, wherein the first timing and the second timing are substantially the same as each other.

20. The electronic device of claim 16, wherein the display driver integrated circuit is configured to:

supply the gate voltage to the second group pixel lines to output the specified image data after supplying a gate voltage to the first group pixel lines when the electronic device is in the landscape mode; and supply the gate voltage in an order in which the first group pixel lines and the second group pixel lines are arranged, to output the specified image data when the electronic device is in the portrait mode.

* * * * *